US008914953B1

(12) United States Patent
Thacker

(10) Patent No.: US 8,914,953 B1
(45) Date of Patent: Dec. 23, 2014

(54) REUSABLE CASKET

(71) Applicant: Thacker Caskets Inc., Clinton, MD (US)

(72) Inventor: Carl Justin Thacker, Fulton, MD (US)

(73) Assignee: Thacker Caskets Inc., Clinton, MD (US)

( * ) Notice: Subject to any disclaimer, the term of this patent is extended or adjusted under 35 U.S.C. 154(b) by 0 days.

(21) Appl. No.: 14/065,836

(22) Filed: Oct. 29, 2013

(51) Int. Cl.
*A61G 17/00* (2006.01)
*A61G 17/007* (2006.01)
*E05B 65/00* (2006.01)

(52) U.S. Cl.
CPC ..... *A61G 17/0076* (2013.01); *E05B 65/0057* (2013.01)
USPC ..... 27/35; 27/6

(58) Field of Classification Search
CPC ... A61G 17/00; A61G 17/0076; A61G 17/04; A61G 2017/00; A61G 2017/04
USPC ..... 27/2, 6, 27, 35, 4
See application file for complete search history.

(56) References Cited

U.S. PATENT DOCUMENTS

| | | | | | |
|---|---|---|---|---|---|
| 3,133,334 | A * | 5/1964 | Johnsen | 27/27 |
| 3,613,189 | A * | 10/1971 | Kirby | 27/35 |
| 3,654,676 | A * | 4/1972 | McHugh | 27/2 |
| 3,810,282 | A * | 5/1974 | Doggett | 27/35 |
| 4,788,757 | A * | 12/1988 | Bethune et al. | 27/2 |
| 6,324,737 | B1 * | 12/2001 | Chamness et al. | 27/2 |
| 6,385,824 | B1 * | 5/2002 | Schwartz | 27/35 |
| 6,684,467 | B1 * | 2/2004 | Walker | 27/35 |
| 7,302,743 | B2 * | 12/2007 | Fash | 27/4 |
| 7,350,278 | B2 * | 4/2008 | Davis et al. | 27/35 |
| 7,475,458 | B1 * | 1/2009 | Gordon et al. | 27/35 |
| 8,127,414 | B2 * | 3/2012 | Rankin | 27/35 |
| 8,607,423 | B2 * | 12/2013 | Davis et al. | 27/35 |

* cited by examiner

*Primary Examiner* — William Miller
(74) *Attorney, Agent, or Firm* — Quinn Law Group, PLLC

(57) ABSTRACT

A reusable casket includes a metal casket box having an opening at one end and including a panel section rotatably attached to the casket box which is closeable to enclose the opening and openable to allow longitudinal movement of a casket insert into and out of the casket box through the opening. A transverse member adjacent the panel section connects opposing side panels of the box to partially define the opening. The panel section is retained to the transverse member in the closed position by locking bolts extending through the panel section to engage the transverse member. A method of making the metal casket box includes welding side, end, and floor panels together, moveably attaching the panel section relative to an opening in the end of the casket box, and attaching the transverse member to the side panels adjacent the panel section.

19 Claims, 11 Drawing Sheets

REUSABLE CASKET

TECHNICAL FIELD

The present disclosure relates to a casket assembly and more specifically to a reusable casket assembly, also known as a display casket or a rental casket.

BACKGROUND

Funeral costs are expensive and include the cost of preparing the body of the deceased, cost of a casket for presentation and/or burial of the deceased, final disposition costs such as cremation costs or interment costs including vault costs, burial costs, etc. The cost of the casket can vary significantly, depending on the types of materials and finishes used, the type of construction, the level of ornamentation, the interior finishing including panels, draping and lining, etc.

In some circumstances, a rental casket, which may also be referred to as a presentation casket, may be desired for temporary presentation of the deceased during visitation or a memorial service. For example, cremation is increasingly being used as an alternative to interment due to personal preference of the deceased or for budgetary reasons to avoid the costs of purchasing, opening and closing a vault and burial site. In such cases, a rental casket may be used temporarily to present the deceased during visitation or mourning. The deceased may be positioned on a removable tray or in a removable container for placement into the rental casket for presentation. The removable container may be, for example, a paperboard, wooden or other suitably flammable container which burns leaving little or no ash, such that the removable container may also be used as a cremation container. After presentation, the removable container including the deceased is removed from the rental casket for cremation. In another example, a rental casket having expensive finishes and ornamentation may be rented for presentation, and the deceased transferred from the rental casket to a less ornate and less expensive casket for permanent interment.

Wooden caskets having a side wall or floor which is removable to facilitate placement and removal of the removable tray or container in which the deceased is positioned into and from the wooden casket have been used as rental caskets. Metal caskets are generally perceived to be of higher quality in terms of aesthetics, strength, durability, etc., such that a metal casket is preferred or desired by a substantial majority for presentation of the deceased. The casket box of a traditional metal casket is fabricated from stamped metal panels which are welded together such that the floor and walls of the metal casket box have a unitary or continuous structure, and such that the casket box is only accessible through the top of the casket box. As such, insertion and subsequent removal after presentation of a tray or container including a deceased into a unitary metal casket box is cumbersome and presents the risk of dropping or disturbing the positioning of the deceased during movement of the tray or container into and out of the metal casket box, and substantially limits or prevents the use of a metal casket as a rental casket.

SUMMARY

A reusable metal casket including a metal casket box is provided. The reusable metal casket may also be referred to as a rental casket, and is configured to display a deceased body contained in a casket insert. The reusable metal casket may be rented for a limited period of time, for example, during visitation and/or funeral services, such that the reusable metal casket is used to temporarily hold the casket insert including the deceased body and for display of the deceased body in the casket insert. The casket insert may be configured as a cremation container such that the casket insert may be cremated with the deceased body, and/or may be configured for transfer to a vault for interment of the deceased. Metal caskets are preferred by 80% of the United States market, and are generally perceived to be of higher quality in terms of aesthetics, strength, durability, etc., such that a metal casket is preferred or desired by a substantial majority for presentation of the deceased. Further, metal caskets can be offered in a variety of metal types and finishes.

The casket box includes side, end and floor panels welded together to form the box structure. The casket box includes an opening in one end allowing longitudinal movement of a casket insert into and out of the casket box through the opening. The casket box includes a panel section rotatably attached to the casket box and movable between a closed position enclosing the opening and an open position allowing longitudinal movement of a casket insert into and out of the casket box through the opening. The casket box further includes a transverse member adjacent the panel section and connecting the opposing side panels such that the opening is partially defined by the transverse member.

A locking member configured to receive a casket key engages the panel section and an interface defined by the transverse member to retain the panel section to the transverse member in the closed position. The locking member may extend through an upper rail defined by the casket box. The upper rail defines an upper surface of the casket box and may further define an upper rail recess. In one example, the transverse member is a substantially straight bar which is positioned within the upper rail recess and attached such that it is flush with the upper surface. In another example, the transverse member includes an arched portion which extends vertically above the upper surface to increase the clearance between the transverse member and the top of the casket insert during movement of the casket insert into and out of the casket box through the opening. The arched transverse member may be attached to the side panels such that it is offset longitudinally from the panel section, and such that the arched portion of the transverse member is received into a lid cavity of a casket lid in a closed-casket position. The transverse member may include an attachment interface to receive a casket lid support, which may be a folding hinge such that the casket lid in the open-casket position is supported by the casket lid support attached to the transverse member.

One or more travel stops may be attached to the casket box and extend into the opening such that the travel stop is in contact with the panel section in the closed position to prevent the panel section from rotating inwardly into the interior space of the casket box. The panel section is rotatably attached to the casket box by a rotatable member, which may be configured as a continuous hinge. A reinforcement member extending the width of the casket box may be fixedly connected to the continuous hinge and the interior surface of the casket box adjacent the continuous hinge to reinforce the continuous hinge and/or to increase the strength and stability of the casket box in the transverse direction.

The casket box may include guides for assisting in the longitudinal movement of the casket insert into and out of the casket box through the opening. In one example, each side panel may include a longitudinal guide rod extending from an inside surface of the side panel, which may be welded or otherwise fixedly attached to the side panel such that the guide rods are in contact with side walls of the casket insert during longitudinal movement of the casket insert into and out of the casket box. The floor panel of the casket box may include guide rails which protrude vertically upward from the floor surface to reduce the contact area between the bottom surface of the casket insert and the floor of the casket, to reduce the effort required to move the casket insert across the floor.

In one example, the end panel defining the opening includes lateral sections fixedly attached to the opposing side panels, where the panel section is intermediate the lateral sections and is moveable relative to the lateral sections. A clearance gap is defined between the panel section and each of the lateral sections, such that the panel section is freely moveable relative to the lateral sections without contact between the edges of the lateral and panel sections. Edge protectors may be affixed to the edges defining the clearance gap for appearance and/or to cushion movement of the panel section relative to the lateral sections. In another example, the panel section is coextensive with the upright portion of the end panel, such that the opening is defined in part by the side walls.

A method of making a reusable metal casket including a metal casket box as described herein is provided. The method includes attaching opposing side panels and opposing end panels to a floor panel to form a casket box, where one of the end panels includes a panel section moveably attached to the casket box such that the panel section is movable between a closed position enclosing an opening in the casket box and an open position allowing longitudinal movement of a casket insert into and out of the casket box through the opening. The method further includes attaching a transverse member to the opposing side panels adjacent the panel section such that the opening is partially defined by the transverse member. The side panels, end panels, floor panel, and panel section are made of metal and attached by welding.

The method may further include perforating one of the end panels to form a plurality of perforations defining the panel section, where the perforations are connected along a cut line by uncut material extending between the perforations along the cut line, and the panel section defined by the perforations is attached to the remaining portion of the end panel by the uncut material. The perforations may be formed by cutting, sawing, slitting, or other metal cutting means. In one example, the perforations are formed by laser cutting the plurality of perforations in the end panel. The method further includes removing the uncut material to separate the panel section from the end panel, where the panel section may be separated from the end panel after the end panel is welded to one of the floor panel and the opposing side panels.

The method further includes rotatably attaching the panel section to the casket box using a rotatable member such as a continuous hinge, by attaching a first hinge plate of a continuous hinge to the panel section and attaching a second hinge plate of a continuous hinge to the casket box such that the panel section is movably attached to the casket box to enclose the opening in the closed position. The method may include attaching a reinforcement member to the second hinge plate and to the casket box inner surface adjacent the second hinge plate, where the reinforcement member extends the width of the casket box and is attached by welding.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Figure 1:
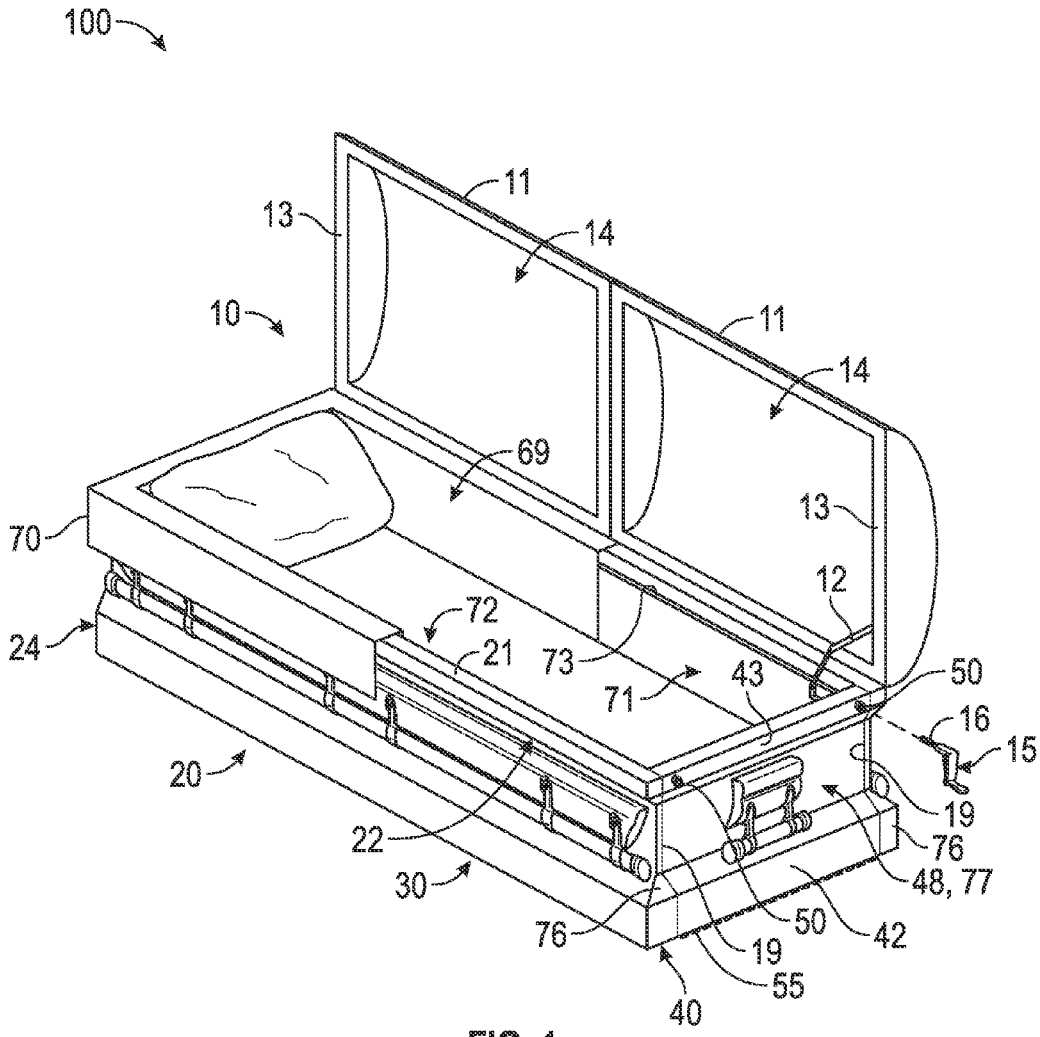
FIG. 1 is a schematic perspective view of a reusable casket system including a casket insert in display position in a casket including a moveable panel section shown in a closed position.
Figure 2:
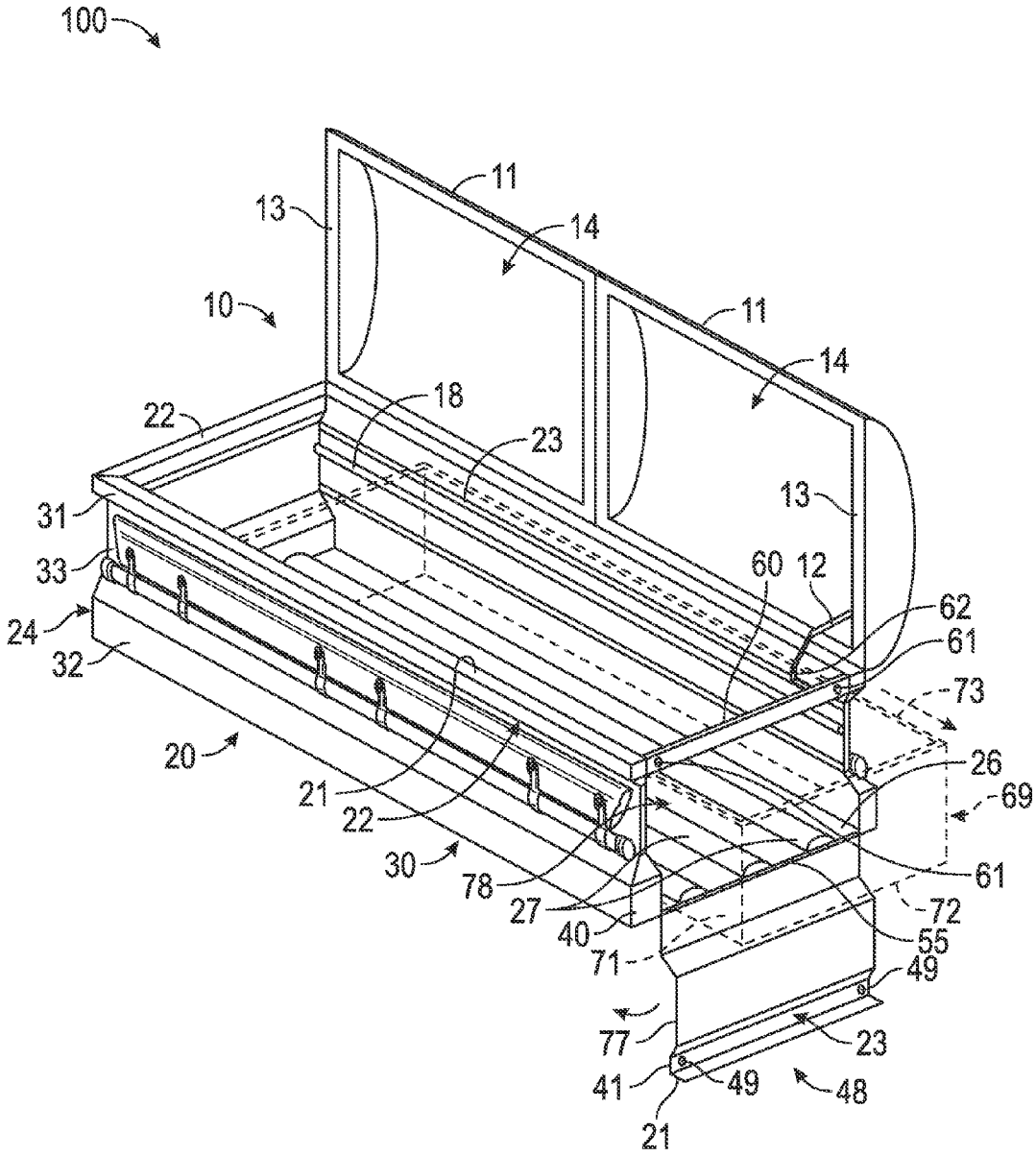
FIG. 2 is an schematic perspective view of the reusable casket system of FIG. 1 showing the moveable panel section in the open position.

Referring to the drawings wherein like reference numbers represent like components throughout the several figures, the elements 50, 68, 79 shown in FIGS. 1-12 are not necessarily to scale or proportion. Accordingly, the particular dimensions and applications provided in the drawings presented herein are not to be considered limiting. A casket system generally indicated at 100 is shown in FIGS. 1 and 2. The casket system 100 includes a reusable metal casket generally indicated at and a non-reusable (single use) casket insert generally indicated at 69 in FIG. 1 and shown in phantom in FIG. 2. The reusable metal casket may also be referred to herein as a rental casket 10 or a display casket 10. The casket insert 69 is configured to contain a deceased body (not shown) prepared for cremation or interment and positioned in the casket insert 69 for display or presentation during visitation, prior to interment or cremation. The casket insert 69 containing the deceased body is placed temporarily in the reusable casket 10 for display or presentation of the deceased body, for example, during visitation or for a memorial service. The reusable casket 10 includes a metal casket box 20 configured to receive the casket insert 69, with the deceased body contained therein, through an opening generally indicated at 78 in FIG. 2. The opening 78 is defined by an end panel 40 of the casket box 20 and a transverse member 60 extending the width of the casket box 20 and connecting the side panels 30 of the casket box 20 adjacent the opening 78. The end panel 40 includes a panel section generally indicated at 48 which is rotatably fastened to the casket box 20 such that the panel section 48 may be rotated away from the casket box 20 to an open position as shown in FIG. 2. The opening 78 defined by the open panel section 48 and the transverse member 60 is of sufficient size (height and width) to receive the casket insert 69 into the casket box 20. The transverse member 60 is fixedly connected to each of the side panels 30 of the casket box 20 adjacent the end panel 40 to reinforce and stabilize the casket box 20 when the panel section 48 is in the open position and during movement of the casket insert 69 in and out of the casket box 20 through the opening 78, as shown in FIG. 2. In the example shown, the casket insert 69 may be moved longitudinally, e.g., lengthwise, in and out of the casket box 20 by sliding the bottom 72 of the insert along the floor panel 26 of the casket box 20. The transverse member 60 is configured and/or positioned such that a clearance is provided between the top surface 73 of the casket insert 69 and the transverse member 60 during movement of the casket insert 69 along the floor panel 26 of the casket box 20 and through the opening 78.

The panel section 48 is rotated to a closed position shown in FIG. 1 and attached to the transverse member 60 during presentation of the deceased body in the reusable casket 10, such that the casket exterior presents a continuous surface. The panel section 48 is retained to the transverse member 60 by locking members 50 configured to be attachable to the casket box 20 using a standard casket key 15, also known as a casket crank 15, shown in FIG. 1. Following display, the movable panel is opened by detaching the locking members 50 using the casket key 15, and the casket insert 69 is removed from the casket box 20 through the opening 78. The removed casket insert 69 and the deceased body contained therein may then be cremated, transferred to another casket, and/or sealed in a vault (not shown) for interment.

Where relative terms such as "side," "end," "upper," "lower," "above," "below," "top," "bottom," "vertical," "horizontal," "longitudinal," "lengthwise," and "transverse" are used herein and in the claims, these terms are intended be relative to the orientation of the casket and/or casket in the display position and/or relative to the corpse in the display position. For example, the floor panel identified at 26 is a generally horizontal panel and defines the bottom of the casket 10; the side panels of the casket 10 identified at 30 are located at the sides of the casket 10 and extend longitudinally, e.g., along the length of the casket 10 and vertically, e.g., upward, from the generally horizontal floor panel 26; the end panels identified at 40 are located at the respective ends of the casket 10 and extend transversely, e.g., across the width of the casket 10, and vertically, e.g., upward, from the generally horizontal floor panel 26; the casket box 20 upper surface identified at 21 is at the top of the casket box 20, etc. For example, the casket insert 69 is moved longitudinally or lengthwise into and out of the casket box 20 through the opening 78. Where relative terms such as "equal," "parallel," and "perpendicular" are used herein and in the claims, these terms are intended be defined as "relative within the manufacturing variation and/or specification tolerances of the components contributing to the characteristics being described." For example, the transverse member indicated at 60 is described herein as connected to the side panels 30 such that the transverse member 60 is "perpendicular" to the side panels 30, which extend the longitudinal length of the casket 10. In the present example, the term "perpendicular" as used herein and in the claims is therefore defined as "equal within the manufacturing variation and/or specification tolerances of the components which are described as being perpendicular." As such, it would be understood that for the present example the transverse member 60 is perpendicular to the side panels 30 within the manufacturing tolerances of the transverse member 60, the side panels 30, and the attachment method, which include the flatness of the transverse member 60, squareness of the side panels 30, and variability in the weld attaching the transverse member 60 to the metal side panels 30.

As shown in FIG. 1, the casket insert 69 includes an insert bottom 72 and insert walls 71. An insert liner 70 lines the interior of the casket insert 69 to cover the interior surfaces of the insert bottom 72 and insert walls 71, and to provide an aesthetically pleasing surface upon which the corpse is positioned. The insert liner 70 may extend from the casket insert 69 over the insert top surface 73 of the insert 69 to cover the insert top surface 73, which may be an unfinished surface. The insert liner 70 may include a pillow or head support and may drape over the side and/or end panels 30, 40 of the casket 10 when the casket insert 69 is in display position, e.g., when at least one of the casket lids 11 is in an open-casket position as shown in FIG. 1. By way of example, the casket liner 70 is made of a fabric which may be a polymer based or organic material, and may be decorated or trimmed to provide an aesthetically pleasing appearance.

The casket 10 includes at least one casket lid 11 configured to enclose the casket box 20. In the example shown, the casket 10 includes two casket lids 11, each attached to the casket box 20 such that the lids 11 are independently pivotable between a casket-open position (shown in FIG. 1) and a casket-closed position (not shown). The casket lid 11 may be domed to define a lid cavity 14, which may be configured to receive a lid insert (not shown). The lid insert is configured to fit into the lid cavity 14 to cover the inside surface of the casket lid 11 and may be, by way of non-limiting example, cloth covered to complement the insert liner 70, and may be decorated, or may be functional including a shelf for receiving a flower vase, etc. The casket lid 11 includes a lid frame 13 which is configured to sealably interface with the upper surface 21 of the casket box 20 when the casket lid 11 is in the closed-casket position. The casket lid 11 may be supported in the open-casket position by a lid support 12, which in the example shown may be a folding hinge attached at a first end to the casket lid 11 and operatively attached at the second end to the casket box 20. In a non-limiting example shown in additional detail in FIGS. 3, 4, 8 and 9, the lid support 12 may be pivotally attached via a pin 17 to an attachment interface 63 defined by the transverse member 60, such that with the lid 11 in the closed-casket position, the lid support 12 is contained within the lid cavity 14. In the example shown in FIGS. 3 and 4, the attachment interface 63 may be defined by an attachment bracket 62 which is integral to the transverse member 60.

Referring now to FIGS. 2-5, the construction of the reusable metal casket box 20 is shown in additional detail. The casket box 20 includes opposing side panels 30, opposing end panels 40, and a floor panel 26. Each of the side, end, and floor panels 30, 40, 26 are made of metal, and are stamped, bent, cut or otherwise formed to their respective net finished shapes prior to being welded together to form the casket box 20. By way of non-limiting example, the side, end and floor panels 30, 40, 26 may be stamped from metal sheet stock such as steel, stainless steel, bronze, or copper sheet stock. The sheet stock used to form the side, end, and floor panels 30, 40, 26 is of sufficient thickness (gauge) such that the casket box 20 formed therefrom is of adequate strength and durability to contain and transport the casket insert 69 and corpse. By way of non-limiting example, the side, end, and floor panels 30, 40, 26 may be formed from one of 16, 18, or 20 gauge stock.

Figure 3:
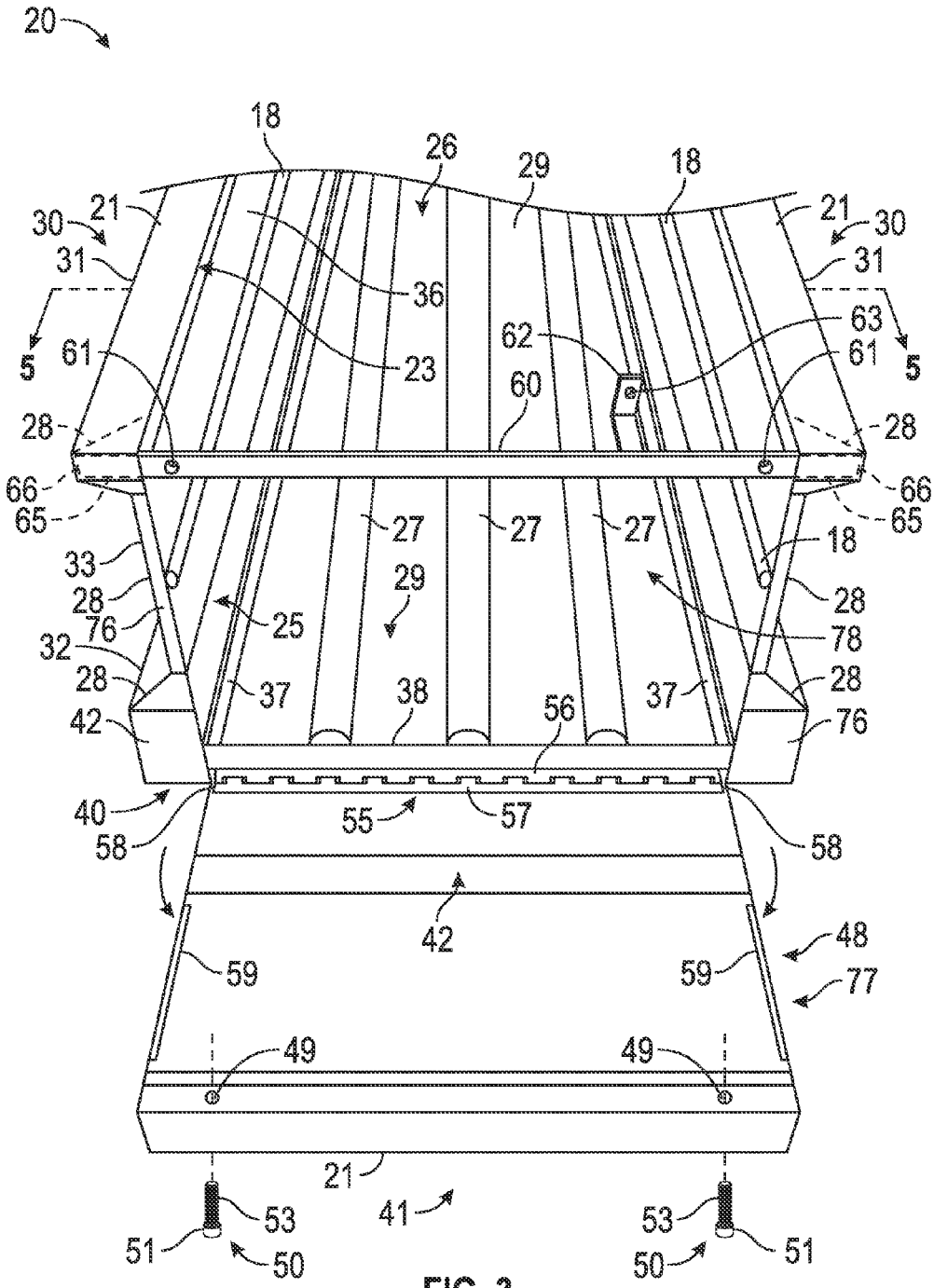
FIG. 3 is a partial schematic perspective end view of a casket box of the casket of FIG. 1 with the moveable panel section in an open position.

The casket box 20 is formed by welding the side, end, and floor panels 30, 40, 26 together. Each of the side and end panels 30, 40 is welded to the floor panel 26, shown in additional detail in FIGS. 3, 4 and 5. The floor panel 26 may be configured as a generally horizontal panel and may further include a plurality of guide rails 27 protruding upwardly from the floor surface 29, and extending longitudinally along the floor panel 26. The guide rails 27 ease or facilitate movement of the casket insert 69 across the floor panel 26 of the casket box 20 by providing a reduced surface area with which the insert bottom 72 interfaces as the casket insert 69 is slidably moved in and out of the casket box 20 through the opening 78. The guide rails 27 may be shaped as shown in FIGS. 3 and 5, to have a hemi-spherical transverse cross-section. Other configurations and shapes of guide rails 27 may be used to provide a reduced surface area as compared with the floor surface 29, to facilitate sliding movement of the casket insert 69 into and out of the casket box 20. For example, the guide rails 27 may be shaped to have a semi-elliptical, semi-cylindrical, or polyhedral cross-section. The guide rails 27 may be fixedly attached to the floor surface 29, for example, by welding or otherwise attaching or adhering each rail to the floor panel 26. In a non-limiting example shown in FIGS. 9 and 10, the guide rails 27 may be integrally formed in the floor panel 26 during stamping or press-forming of the floor panel 26.

Each side panel 30 extends longitudinally the length of the casket box 20, and is welded to a longitudinal edge of the floor panel 26 such that in the welded position the side panel 30 extends vertically upward from the generally horizontal floor panel 26. Optionally, a longitudinal reinforcing rail 37 may be positioned as shown in FIG. 3 adjacent each longitudinal weld seam (not shown) joining the side panel 30 to the floor panel 26, to further reinforce and/or strength the casket box 20 in the longitudinal direction. The longitudinal reinforcing rail 37 may be a metal bar made of the same metal as the floor and side panels 26, 30 and/or of a metal which is weld-compatible with the metal of the floor and side panels 26, 30 such that that reinforcing rail 37 may be attached by welding to one or both of the floor and side panels 26, 30 adjacent the longitudinal weld seam 28.

Each of the end and side panels 40, 30 is net formed prior to welding. In the example shown, the metal end and side panels 40, 30 may be stamped, bent, cut or otherwise formed from metal sheet stock to provide, by way of non-limiting example, the net finished shape of the end and side panels 40, 30 shown in FIGS. 1-3. "Net formed" and "net finished shape" as those terms are used herein, are intended to indicate the panels 26, 30, 40 are provided in a condition such that the only remaining fabricating required to obtain the final exterior shape of the casket box 20 is to weld the panels 26, 30, 40 together, and to smooth finish the welded seam by grinding and/or polishing the welded seam to remove any weld irregularities, weld spray, etc. Additional finishing, such as surface finishing, to obtain a surface texture or finish such as a painted, polished or brush finish, or attaching fixtures such as handles, decorative trim and/or ornamentation, locking hardware, seals, gaskets, etc., may be performed subsequent to welding the panels 26, 30, 40 together as these finishing operations do not affect the "net formed" or "net finished shape" of the panels 26, 30, 40 themselves. As compared to wooden caskets, metal caskets 10 may be formed in more ornate and complex shapes by stamping, bending, or otherwise forming the side and end panels 30, 40 to define exterior profiles which may be difficult and more labor intensive to duplicate using wood-based materials. Further, duplicating such profiles in wood requires the use of relatively thicker sections of wood material to provide comparable strength to that of the same profile formed from metal sheet, which decreases the interior space of a wood casket compared to a metal casket having the same exterior profile, and which may also increase the weight of the wood casket as compared with a metal casket 10 having the same exterior profile. In the example shown in FIGS. 1-3, the exterior profile of the casket box 20 includes an upper rail 22 defining an upper rail recess 23 and an upper surface 21, and a lower railing 24 defining a lower rail recess 25. Both the upper rail 22 and lower rail 24 are angled and mitered to join a generally vertical intermediate portion which is inset relative to the upper and lower rails 22, 24. The upper and lower rails 22, 24 and upper and lower rail recesses 23, 25 and angled and mitered surfaces are readily formed by stamping and/or bending metal sheets to form the side and end panels 30, 40. The side and end panels 30, 40 are welded together such that the casket box 20 includes an upper rail 22 comprising the side and end upper rail portions 31, 41. The upper rail 22 defines an upper rail recess 23 and the upper surface 21 of the casket box 20, against which the casket lid 11 frame interfaces and/or seals with the casket lid 11 in the closed-casket position.

Figure 4:
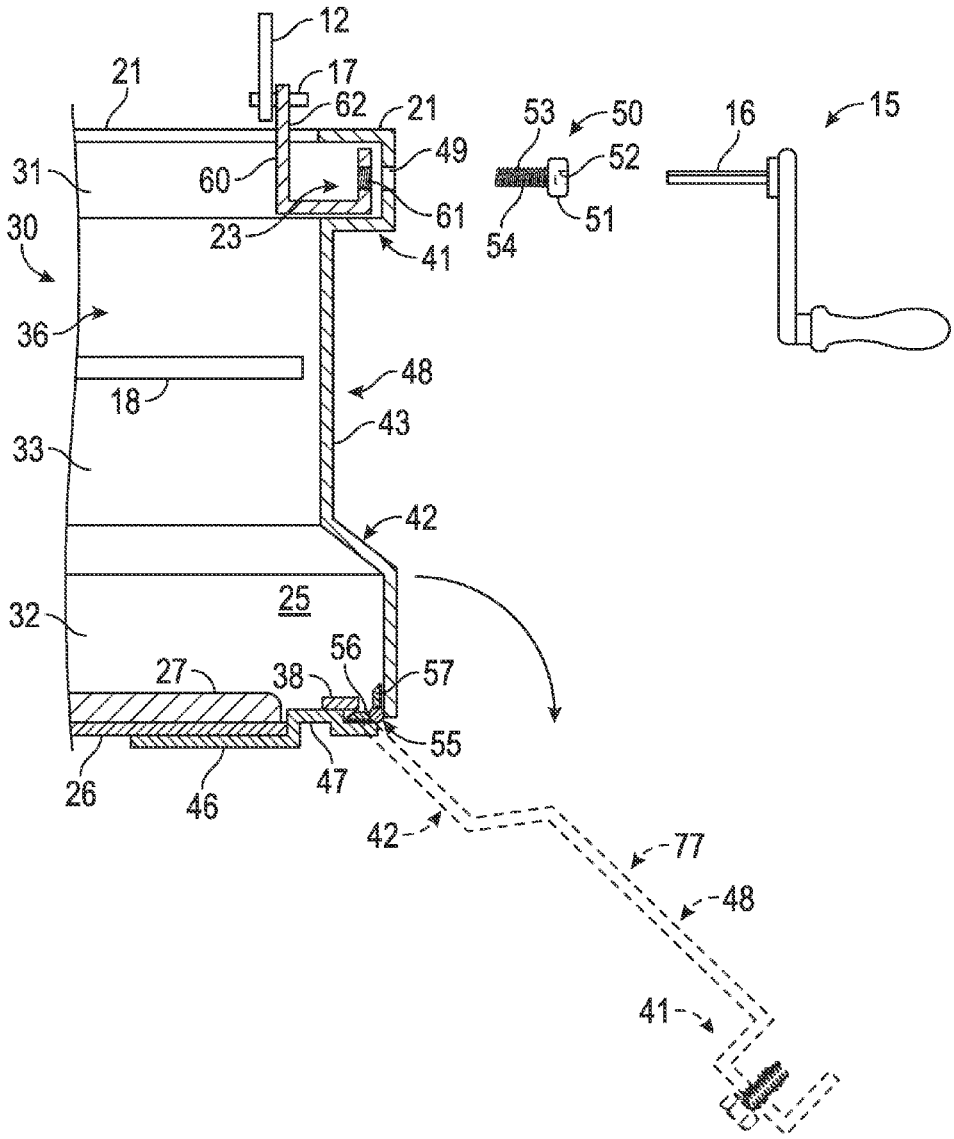
FIG. 4 is a partial schematic cross-sectional and exploded view of section 4-4 of the casket box of FIG. 5 including a threaded interface, a locking bolt and a locking key.
Figure 5:
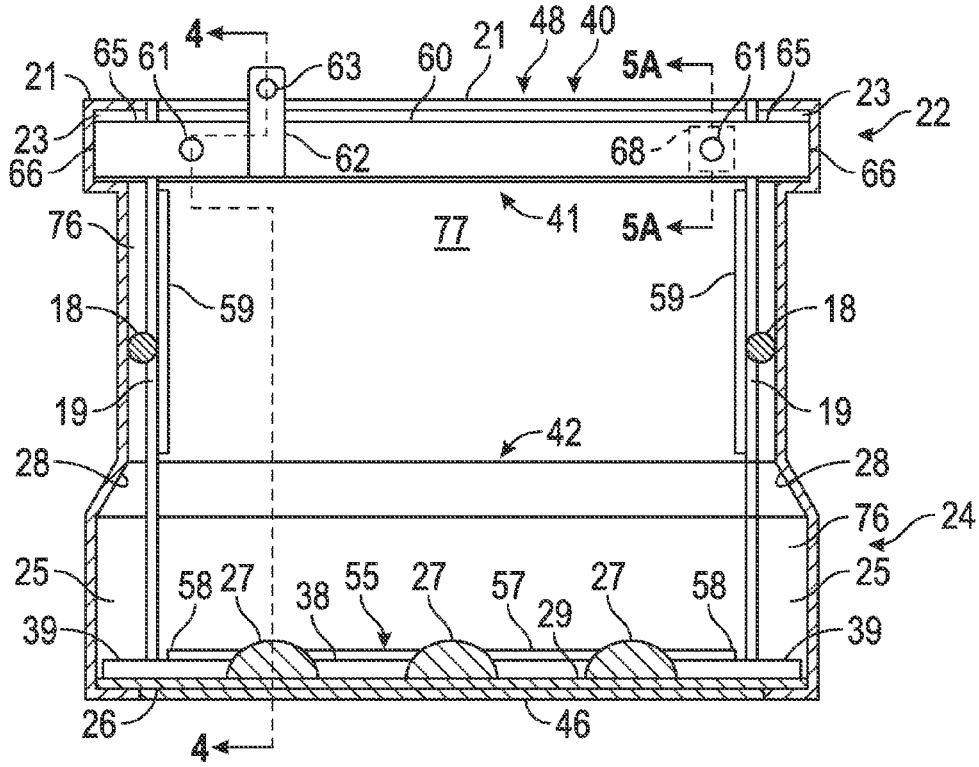
FIG. 5 is a partial schematic cross-sectional view of section 5-5 of the casket box of FIG. 3 with the moveable panel section in the closed position.
Figure 11:
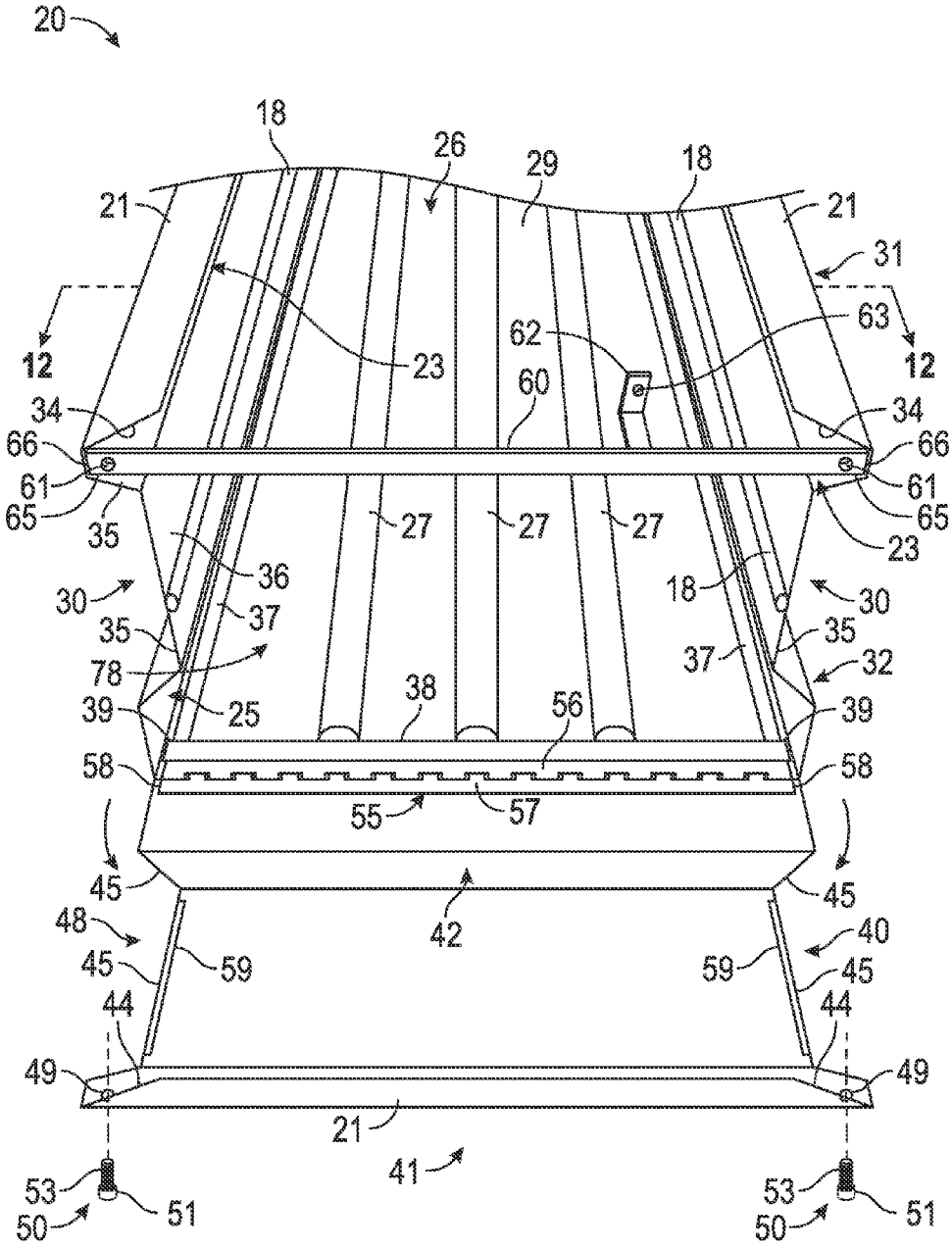
FIG. 11 is a partial schematic perspective end view of another alternate configuration of the casket box of the casket of FIG. 1 with the moveable panel section in an open position.

Referring now to FIGS. 3, 4 and 5, the opposing side panels 30 may be formed as mirror image pairs to provide a left side panel 30 and a right side panel 30. In the non-limiting example shown, each of the side panels 30 is net formed to include a side upper rail portion 31, a side lower rail portion 32, and a side intermediate portion 33 therebetween, as shown in FIGS. 2 and 3. The side upper rail portion 31 and side lower rail portions 32 each extend laterally outward relative to the side intermediate portion 33 such that the side panel interior surfaces 36 of the side upper rail portion 31 and side lower rail portion 32 define, respectively, an upper rail recess 23 and a lower rail recess 25 in the interior space of the casket box 20. The side upper rail portion 31 partially defines the upper surface 21 of the casket box 20. The side panel 30 terminates longitudinally at each end at a side panel edge which is partially mitered to follow the contour of the side panel 30, such that the side panel edge includes side vertical edge portions 35 and side mitered edge portions 34 as shown in FIG. 11. As shown in FIGS. 2 and 3, a guide rod 18 is attached to the side interior surface 36 of each of the side panels 30, for example, by welding the guide rod 18 to the side panel 30. The guide rod 18 extends the longitudinal length of the side panel 30, and protrudes inwardly from the side panel 30 such that the insert walls 71 of the casket insert 69 are in continuous contact with the guide rods 18 as the casket insert 69 is moved into or out of the casket box 20, to guide and center the casket insert 69 in the casket box 20, to prevent interference of the casket insert 69 with the side interior surface 36 of the casket box 20, to align the casket insert 69 longitudinally within the casket box 20, and to prevent sideways movement of the casket insert 69 in the casket box 20, for example, during transport of the casket. The guide rods 18, in the example shown, are shaped as generally cylindrical rods. It would be understood that other configurations of guide rods 18 may be used which have a cross-sectional shape such that the guide rod 18 attached to the side wall protrudes or extends inwardly from the side interior surface 36 to provide a reduced surface area relative to the side interior surface 36 to make contact with and guide the longitudinal movement of the casket insert 69 relative to the casket box 20. For example, the guide rods 18 may be shaped similarly to the guide rails 27, e.g., with a hemi-spherical cross-section, or may have a semi-cylindrical, semi-elliptical or polyhedral cross-section.

Figure 6C:
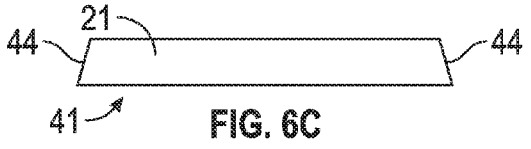
FIGS. 6A-6D are respectively front, bottom, top, and side views of the end panel of the casket box of FIG. 1 in an as formed condition.
Figure 6A:
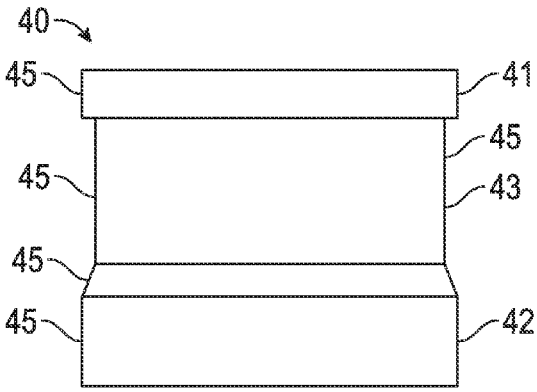
Figure 6B:
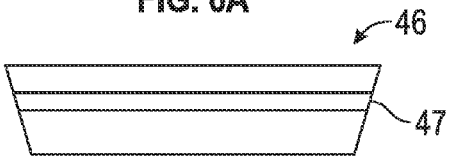
Figure 6D:
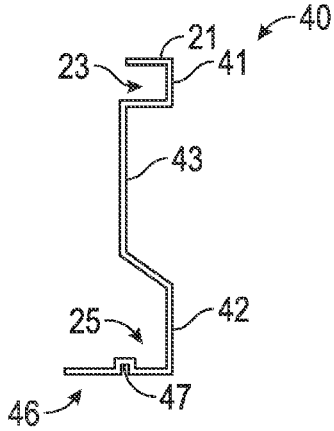

Referring to FIGS. 2, 4 and 6A-6D, the opposing end panels 40 may be formed as mirror image pairs to provide a head end panel 40 and a foot end panel 40. In the non-limiting example shown, each of the end panels 40 is net formed to include an end upper rail portion 41, an end lower rail portion 42, and an end intermediate portion 43 therebetween, as shown in FIGS. 4 and 6A-6D. The end upper rail portion 41 and end lower rail portions 42 each extend longitudinally outward relative to the end intermediate portion 43 such that the end panel 40 interior surfaces of the end upper rail portion 41 and end lower rail portion 42 define, respectively, an upper rail recess 23 and a lower rail recess 25 in the interior space of the casket box 20. The end upper rail portion 41 partially defines the upper surface 21 of the casket box 20. The end panel 40 terminates laterally at each end at an end panel edge which is partially mitered to follow the contour of the end panel 40, such that the end panel edge includes end vertical edge portions 45 and end mitered edge portions 44, as shown in FIGS. 6A and 6C.

The end panel 40 further includes a bottom portion 46 shown in FIGS. 4, 5, 6B and 6D, which extends horizontally from the end panel lower rail portion 42. The end panel bottom portion 46 includes an integral channel 47 formed into the bottom portion 46, which acts as a stiffening element 47 to strengthen and/or stabilize the end panel 40 and the casket box 20 laterally. The bottom portion 46 is welded to the floor panel 26 to attach the end panel 40 to the floor panel 26. The mitered edge portions 44 of the bottom portion 46 of the end panel 40 are welded to the mating side panel miter edge portions 34 to join the bottom portion 46 of the end panel 40 to each of the side panels 30.

At least one of the end panels 40 includes a movable panel section 48 which is rotatable between an open and closed position to define the opening 78 through which the casket insert 69 may be inserted into and removed from the casket box 20. In the example shown in FIGS. 1-2 the foot end panel 40 includes the movable panel section 48. It would be understood that the head end panel 40 could include the movable panel section 48, or that both the head end panel 40 and the foot end panel 40 could be configured to include a movable panel section 48 as described herein, thereby providing openings 78 at each end of the casket box 20 through which the casket insert 69 could be moved into and out of the casket box 20. As shown in FIG. 3, the movable panel section 48 is rotatably attached at the transition from the end panel lower rail portion 42 to the end panel bottom portion 46, such that the movable panel section 48 can be rotated from a closed position to an open position, where in the open position the movable panel section 48 is level with or vertically lower than the floor panel 26 (see FIG. 4), such that the movable panel section 48 does not interfere with movement of the casket insert 69 into or out of the casket box 20, and the weight of the casket insert 69 including the deceased body is not resting on the movable panel section 48 during movement of the casket insert 69.

In the closed position, a clearance gap 19 is defined between the vertical edges of the movable panel section 48 and the adjacent portions of the casket box 20, as shown in FIGS. 1 and 5, to allow movement of the panel section 48 relative to the adjacent portions of the casket box 20. Edge protectors 59, as shown in FIGS. 3 and 5, may be applied to the vertical edges of the panel section 48, to preserve the finish on the vertical edges of the panel section 48 and/or to cushion the vertical edges of the panel to prevent inadvertent contact between or scuffing of the edges of the panel section 48 and adjacent portions of the casket box 20, for example, during opening and closing of the panel section 48 or during movement of the casket box 20 with the panel section 48 in the closed position. The edge protectors 59, by way of non-limiting example, may be made of a polymer or rubber based material and may be grooved to slip fit onto the edges of the panel section 48. The edge protectors 59 may be finished to correspond to the color and/or finish of the metal panels 26, 30, 40 of the casket box 20, or may be made of a clear polymer such that the edge protectors 59 are minimally visible on the movable panel. As shown in FIGS. 3 and 5, the moveable panel is of sufficient width such that the opening 78 provided by the moveable panel in the open position is at least the width of the narrowest portion of the casket box 20 interior, which in the example shown in the transverse width between the guide rods 18. As such, the opening 78 is sufficiently wide to receive a casket insert 69 having the maximum width which can fit between the guide rods 18, e.g., a casket insert 69 of the maximum width which can be slidably inserted into the casket box 20.

As shown in FIGS. 3 and 4, the panel section 48 is rotatably attached to the bottom portion 46 of the end panel 40 and operatively connected to the floor panel 26 of the casket box 20 via a rotatable member generally indicated at 55. The rotatable member 55 may be, for example, a metal piano hinge 55 or metal continuous hinge 55 including first and second hinge plates 56, 57 which are rotatable relative to each other to define an angle of at least 180 degrees therebetween. In the example shown, the first hinge plate 56 is rotatable to 270 degrees from the second hinge plate 57, such that with the first hinge section operatively attached to the floor panel 26 and the second hinge plate 57 attached to the panel section 48, the panel section 48 in the open position is rotatable more than 180 degrees from the floor panel 26 in the direction of the arrows shown in FIGS. 3 and 4, and as shown in FIG. 4. The continuous hinge 55 extends the width of the panel section 48 such that each end 58 of the continuous hinge 55 extends to the edge of the panel section 48 and substantially to the perimeter of the opening 78 to provide support to the panel section 48 substantially across the entire transverse width of the panel section 48, as shown in FIGS. 3 and 5. The continuous hinge 55 is fixedly attached to the bottom portion 46 of the end panel 40, for example, by welding the first hinge plate 56 to the bottom portion 46 of the end panel 40. The second hinge plate 57 is fixedly attached to the panel section 48, for example, by welding the second hinge plate 57 to the panel section 48 to rotatably attach the panel section 48 to the casket box 20. As shown in FIGS. 3-5, a metal reinforcement member 38 overlaps the first hinge plate 56 and is fixedly attached to the casket box 20, for example, by welding the reinforcement member 38 to the first hinge plate 56 and to the bottom portion 46 of the end panel 40 adjacent the first hinge plate 56 to reinforce the continuous hinge 55 and the attachment of the first hinge plate 56 to the bottom portion 46 of the end panel 40. The reinforcement member 38 extends the width of the floor panel 26, as shown in FIG. 5 in an interior view of the end of the casket box 20, and is fixedly attached to the casket box 20 across the transverse width of the casket box 20, for example, by welding the end portions 39 of the reinforcement member 38 to the side panels 30 at weld attachment points 66. The reinforcement member 38 welded to the casket box 20 across the transverse width of the casket box 20 reinforces the casket box 20 and the opening 78 in the transverse direction, for example, during movement of the casket insert 69 into and out of the casket box 20 through the opening 78. As shown in FIG. 4 in one example, the first hinge plate 56 may be positioned to abut or be adjacent to the integral channel 47 extending the width of the bottom portion 46 of the end panel 40, and the reinforcement member 38 may be positioned to overlap and be welded to both the first hinge plate 56 and the integral channel 47 to reinforce the hinge plate and casket box 20 across the width of the opening 78 and across the width of the casket box 20. The reinforcement member 38 may be, for example, configured as one of a metal bar, a metal plate, or a metal rod.

As shown in FIGS. 2-5, the panel section 48 includes at least one through hole 49 configured to receive the locking element 50 which is used to attach the panel section 48 to the casket box 20 in the closed position, and specifically, to attach the panel section 48 to the transverse member 60 extending across the top of the opening 78 and connecting the upper rail portions 31 of the side panels 30. In the example shown, the panel section 48 includes two through holes 49 located in the upper rail 22 portion of the panel section 48. The through holes 49 are located adjacent the vertical edges of the panel section 48 such that the panel section 48 is attached to the transverse member 60 adjacent the clearance gaps 19 defined between the panel section 48 and the portions of the casket box 20 adjacent the panel section 48, and such that the panel section 48 is flush to the end panel 40 in the closed position.

In a first example configuration shown in FIGS. 1 through, the transverse member 60 is configured as a flat bar which extends across the top of the opening 78 and is attached at either end 65 of the transverse member 60 to the side upper rail portion 31 such that the side panels 30 are connected by the transverse member 60. The transverse member 60 may also be referred to herein as a cross bar 60, or bracing bar 60. In the example shown, the transverse member 60 is made of metal and defines opposing ends 65 of the transverse member 60. Each transverse member end 65 is positioned in a respective side panel 30 upper rail recess 23 of the opposing side panels 30 and is welded to the side interior surface 36 of the side panel 30 at a weld attachment point indicated at 66, such that the transverse member 60 connects the opposing side panels 30 and reinforces the casket box 20 and the opening 78 in the transverse direction. The transverse member 60 is connected to the side panels 30 such that the transverse member 60 is perpendicular to the side panels 30, and parallel to the floor surface 29 and the reinforcement member 38, such that the transverse member 60, side panels 30, floor panel 26, and reinforcement member 38 cooperate to establish and stabilize the squareness of the casket box 20 and opening 78, to maintain alignment of the panel section 48 to the opening 78 over time and after repeated use of the rental casket 10, e.g., after repeatedly moving multiple casket inserts 69 into and out of the casket box 20 over time.

The transverse member 60 may include, as described previously, an attachment bracket 62 including an attachment interface 63 to attach a lid support 12. The attachment bracket 62 may be integral to the transverse member 60, for example, the attachment bracket 62 may be formed during stamping or blanking of the transverse member 60, or may be fixedly attached to the transverse member 60, for example, by welding, riveting, bolting, etc. In a non-limiting example, the lid support 12 may be rotatably attached to the attachment interface 63 via a pin 17, as shown in FIG. 4, or may be clipped, welded, or otherwise attached to the attachment interface 63 such that the lid support 12 is operable to support the casket lid 11 in an casket-open position and to be folded or otherwise collapsed or when the casket lid 11 is in the casket-closed position.

The example of a transverse member 60 made of metal is not intended to be limiting, and it would be understood that the transverse member 60 may be made of other materials, including non-metal and/or metal reinforced materials, having sufficient strength and stability to reinforce the casket box 20 and/or opening 78 in the transverse direction when fixedly attached to the opposing side panels 30. For example, the transverse member 60 may be made of a high strength polymer which may be reinforced with a metal insert and/or strengthening fibers. The transverse member 60 may be attached to the side panels 30 by methods other than welding, for example, the transverse member 60 may be attached to clips or brackets (not shown) affixed to the side interior surface 36 of the side panels 30 to configured to receive and fixedly attach the transverse member 60 to the side panel 30 by attachment means which may include, but are not limited to welding, soldering, press-fitting, fastening by rivets, bolts, clips or other fasteners, etc.

Figure 5A:
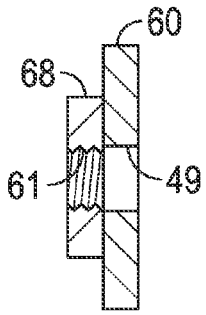
FIG. 5A is a schematic cross-sectional view of section 5A-5A of FIG. 5 showing an alternate configuration of the threaded interface of FIG. 4.
Figure 5B:
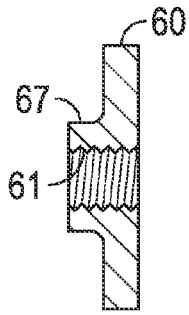
FIG. 5B is a schematic cross-sectional view of section 5A-5A of FIG. 5 showing another alternate configuration of the threaded interface of FIG. 5.

In the example shown in FIGS. 1-5, the transverse member 60 includes one or more locking member interfaces 61 each configured to receive and attach a locking member 50, and located to correspond to and align with a through hole 49 in the panel section 48 when the panel section 48 is in a closed position, such that a locking member 50 inserted through the through hole 49 of the panel section 48 can engage the corresponding locking member interface 61. The locking member interface 61 may be a threaded hole defined by, e.g., formed in, the transverse member 60 and extending through the thickness of the transverse member 60, as shown in FIG. 4, and may be referred to herein as a threaded interface 61. The example is non-limiting, and other configurations of the locking member interface 61 may be used. For example, as shown in FIGS. 5 and 5A, the transverse member 60 may define a through hole 49, and may further include a threaded element 68, such as a threaded block, a threaded sleeve, or a nut, which may be attached to the transverse member 60 in alignment with the through hole 49, such that the locking member 50 can be received through the through hole 49 and engaged to the locking member 50. The threaded element 68 can be attached to the transverse member 60, for example, by welding, brazing, clipping or otherwise adhering or fastening the threaded element 68 to the transverse member 60. In another example shown in FIG. 5B, the transverse member 60 may be formed to include a flanged portion 67 which defines the threaded interface 61, to extend the number of threads and the threaded length longer than that which can be provided by the thickness of the transverse member 60. Not shown but understood, the receiving side of the threaded interface 61 may be chamfered to guide the locking member 50 into engagement with the threads of the threaded interface 61.

The locking member 50 may be a bolt 50 or other threaded fastener which may be driven or fastened using a standard casket key 15. In the example shown, the locking member 50 is a recessed head bolt 50 having a bolt head 51 defining a bolt head recess 52 corresponding to a driver segment 16 of the casket key 15. The driver segment 16 and the bolt head recess 52 may both define a hexagon cross-section, such that he hexagonal driver segment 16 can be received into the hexagon bolt head recess 52 to drive, e.g., rotate and thread the locking member 50 into the threaded interface 61. In one example, the driver segment 16 is a 5/16 inch hexagonal driver and the bolt 50 recess is configured to be driven by a 5/16 inch hexagonal driver. The bolt 50 includes a bolt shank 53 which is threaded such that the bolt threads 54 correspond to, e.g., can be threadably engaged with, the threads of the threaded interface 61. The bolt shank 53 and bolt threads 54 are of sufficient length such that the bolt threads 54 can engage with the threaded interface 61 when the bolt head 51 is in contact with the exterior surface of the panel section 48 in an installed position. The lockable member may be finished and/or configured to match or complement the exterior finish and/or exterior color of the casket box 20.

As shown in FIGS. 1-4, the panel section 48 can be rotated via the rotatable element, which in the example shown is a continuous hinge 55, to a closed position, and the lockable member inserted through the through hole 49 in the panel section 48 to engage the threaded interface 61 of the transverse member 60 to retain the panel section 48 in the closed position. The lockable member can be engaged with the threaded interface 61 using the casket key 15 to drive the lockable member. The through hole 49 in the panel section 48 and the threaded interface 61 are aligned such that the panel section 48 in the closed position is substantially in alignment and substantially flush with the casket box surfaces adjacent the panel section 48 to provide an aesthetically pleasing exterior appearance of the casket box 20. For example, in the example shown in FIGS. 1-5, the movable panel section 48 is defined by a central section 77 of the end panel 40 which is between and adjacent to lateral sections 76 of the end panel 40. As will be described in further detail herein, the movable panel section 48 in this example may be cut from the end panel 40 during fabrication of the casket to optimize fit and alignment of the movable panel section 48 to the opening 78 in the closed position. In the closed position and retained by the locking members 50 engaged to the transverse member 60 in the installed position, the panel section 48 is aligned relative to the adjacent lateral sections 76 of the end panel 40 such that the exterior surface of the panel section 48 is substantially flush with the adjacent exterior surface of the lateral sections 76 of the end panel 40. Further, the panel section 48 in the installed position is engaged to the transverse member 60 such that the clearance gaps 19 between the closed panel section 48 and the adjacent lateral sections 76 (see FIG. 5) are uniform in width along the vertical length of each clearance gap 19, to provide an aesthetically pleasing appearance and to prevent interference of the panel section 48 with the adjacent lateral sections 76 during opening and closing, and/or to avoid contact between and/or scuffing of the edges of the panel section 48 and lateral sections 76 defining the clearance gaps 19.

Figure 8:
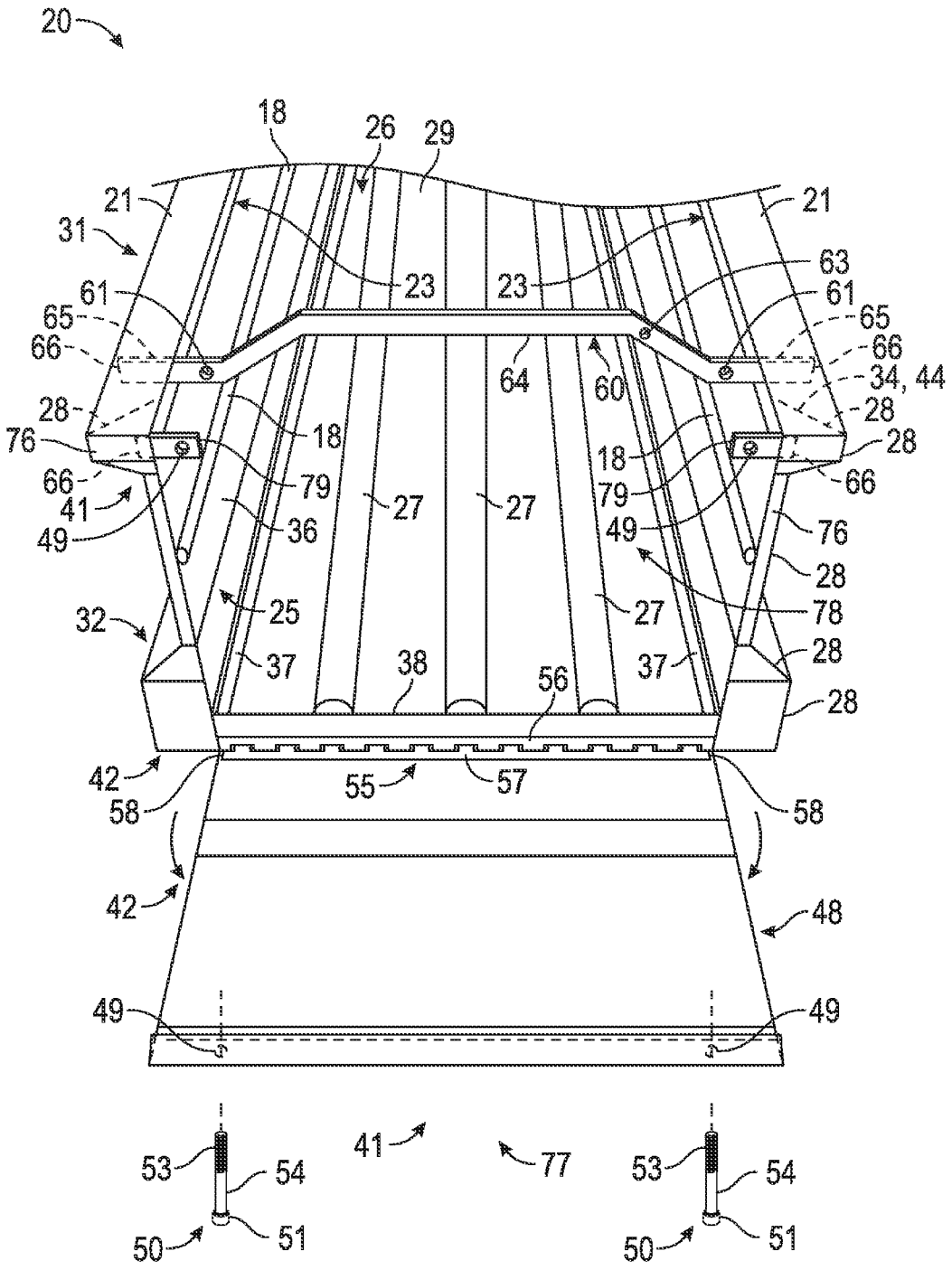
FIG. 8 is a partial schematic perspective end view of an alternate configuration of the casket box of the casket of FIG. 1 with the moveable panel section in an open position.
Figure 9:
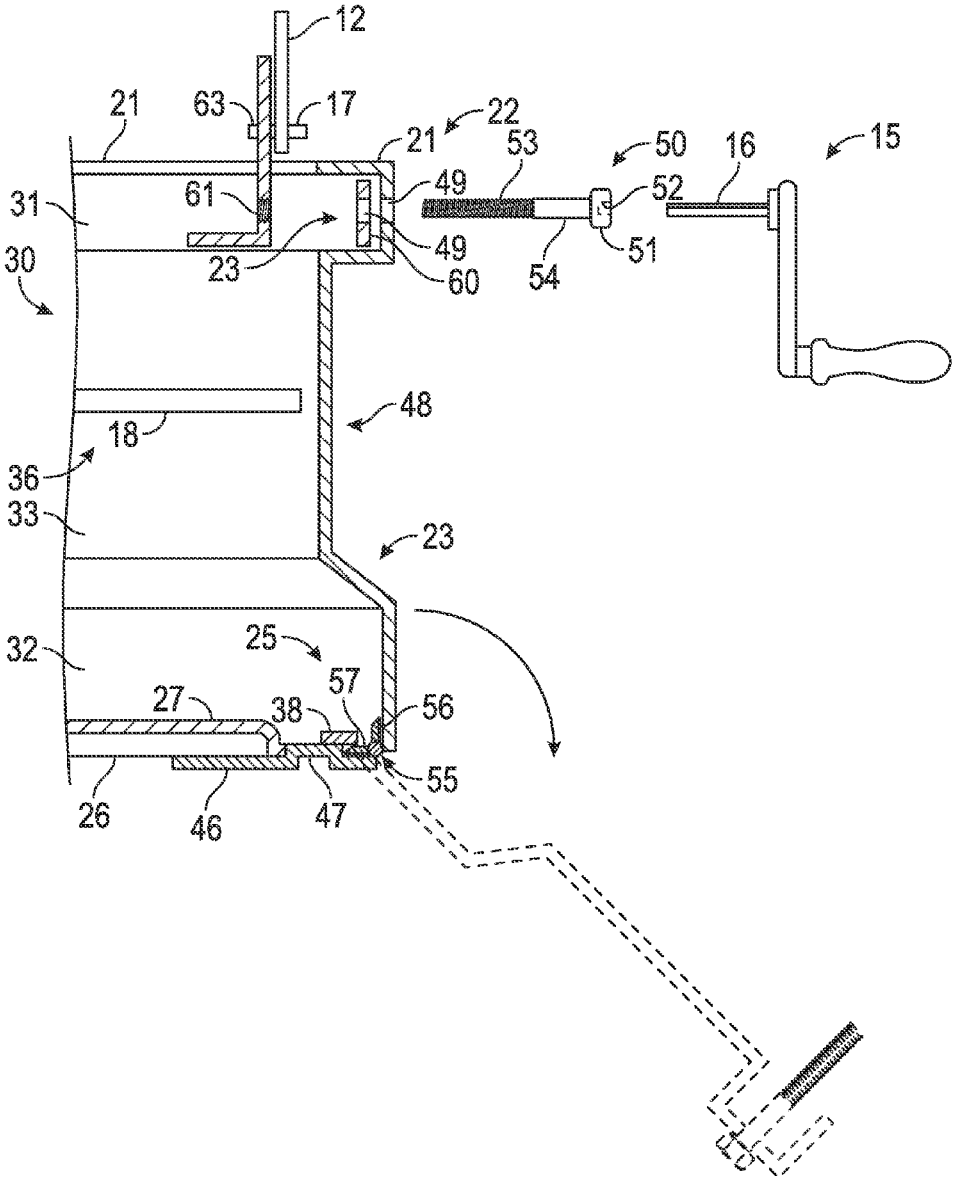
FIG. 9 is a partial schematic cross-sectional view of section 9-9 of the casket box of FIG. 10.
Figure 10:
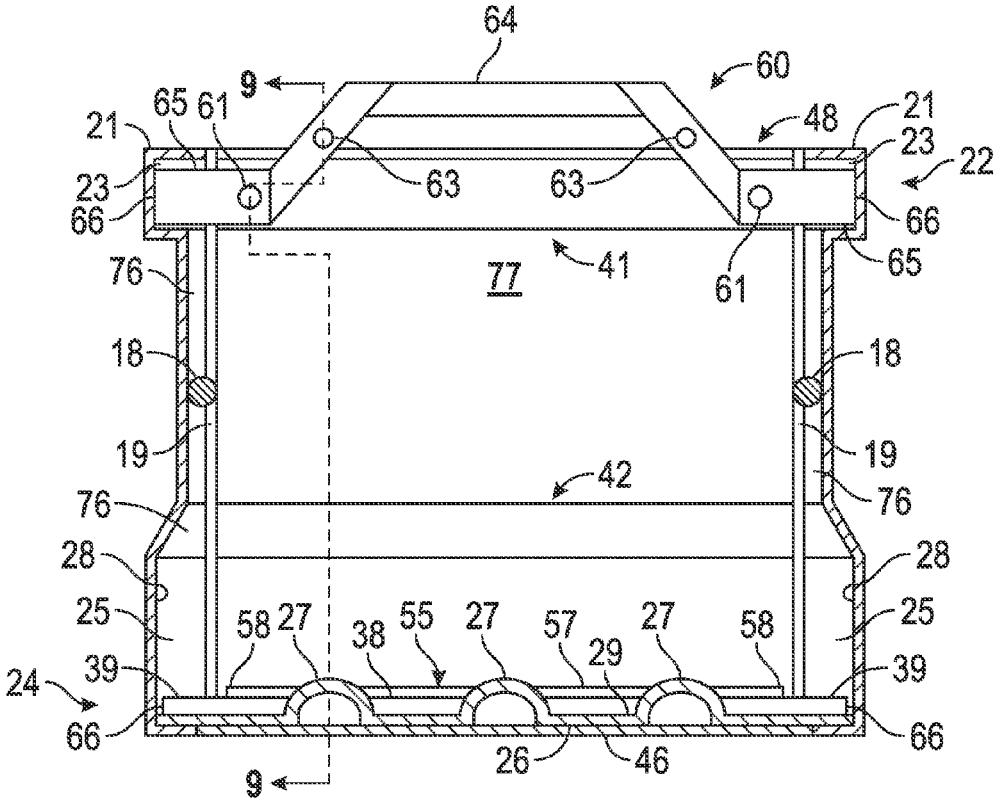
FIG. 10 is a partial schematic cross-sectional end view of the interior of the casket box of FIG. 8 with the moveable panel section in the closed position.

In another example shown in FIGS. 8-10, the transverse member 60 may be arched to increase the clearance between the transverse member 60 and the insert top surface 73 during movement of a casket insert 69 into and out of the casket box 20. As shown in FIGS. 8-10, the transverse member 60 may include an arched portion 64 which may be integral to the transverse member 60. In one example, the arched transverse member 60 may be stamped or blanked from metal sheet stock. In another example, the arched transverse member 60 may be formed by welding metal segments together to form the transverse member 60 including the arched portion 64. The arched transverse member 60 may be fixedly attached to the opposing side panels 30 as shown in FIGS. 8 and 9, such that the transverse member 60 is offset longitudinally inboard from the end panel 40 and/or end of the casket box 20, and such that with the casket lid 11 in the closed-casket position the arched portion 64 of the transverse member 60 extends into the lid cavity 14, so as not to interfere with the casket lid 11 and to allow for full closure and/or sealing of the casket lid 11 against the upper surface 21 of the casket box 20. The transverse member ends 65 may be located in the upper rail 22 recessed and welded to the side interior surfaces 36 at weld attachment points 66, such that the arched transverse member 60 is located substantially perpendicular to the side panels 30 and parallel to the opening 78. In the example shown, the arched portion 64 includes an attachment interface 63 for attaching the lid support 12.

In the example shown in FIGS. 8-10, travel stops 79 are fixedly attached to the lateral sections 76 of the end panel 40 and extend from the upper rail recess 23 into the opening 78. The panel section 48 in the closed position contacts the travel stops 79, which prevent inward movement of the panel section 48 into the interior area of the casket box 20. The panel section 48 is retained against the travel stops 79 in a generally vertical position to align the panel section 48 such that it is flush with the adjacent lateral sections 76 of the end panel 40 in the closed position. Each of the travel stops 79 defines a through hole 49 and is positioned relative to the lateral sections 76 of the end panel 40 and relative to the transverse member 60 such that each through hole 49 of the travel stop 79 is in alignment with a respective corresponding through hole 49 of the panel section 48 and threaded interface 61 defined by the arched transverse member 60. The panel section 48 is retained to the casket box 20 in the closed position by locking members 50 which are of sufficient length as shown in FIG. 9 to extend through the through hole 49 of the panel section 48 and the through hole 49 of the travel stop 79 to engage the threaded interface 61 of the transverse member 60.

The example shown in non-limiting, and other configurations of travel stops 79 may be used. For example, the travel stop 79 may be configured to extend sufficiently into the opening 78 to prevent inward movement of the panel section 48 into the interior area of the casket box 20, but not interfere with passage of the locking member 50 through the through hole 49 of the panel section 48 to the threaded interface 61 of the transverse member 60. For example, the travel stops 79 may each be configured as tabs attached to the lateral sections 76 which extend into the opening 78 to interfere with the panel section 48 without interfering with the locking member 50. The tabs 79 may be metallic or non-metallic, and may be attached to the lateral sections 76, for example, by welding, soldering, by an adhesive, or by a fastener such as a clip. In another example, a thin rod, cable or wire may be extended across the top of the opening 78 and attached to upper rail portions 41 of the lateral sections 76 such that the cable, for example, interferes with inward movement of the panel section 48 into the interior area of the casket box 20, while providing clearance for passage of the locking members 50 through the through holes 49 of the panel section 48 to the threaded interfaces 61 of the arched transverse member 60, and while providing clearance for the movement of the casket insert 69 into and out of the casket box 20 through the opening 78. Additionally, the travel stop 79 configured as a cable or similar element extending transversely across the opening 78 may be fixedly attached to the panel section 48 upper rail 22 portion to contact and support the panel section 48 across its transverse width in the closed position, and to resist sag or flexing of the panel section 48, and to maintain flushness and alignment of the panel section 48 to the lateral sections 76.

Figure 12:
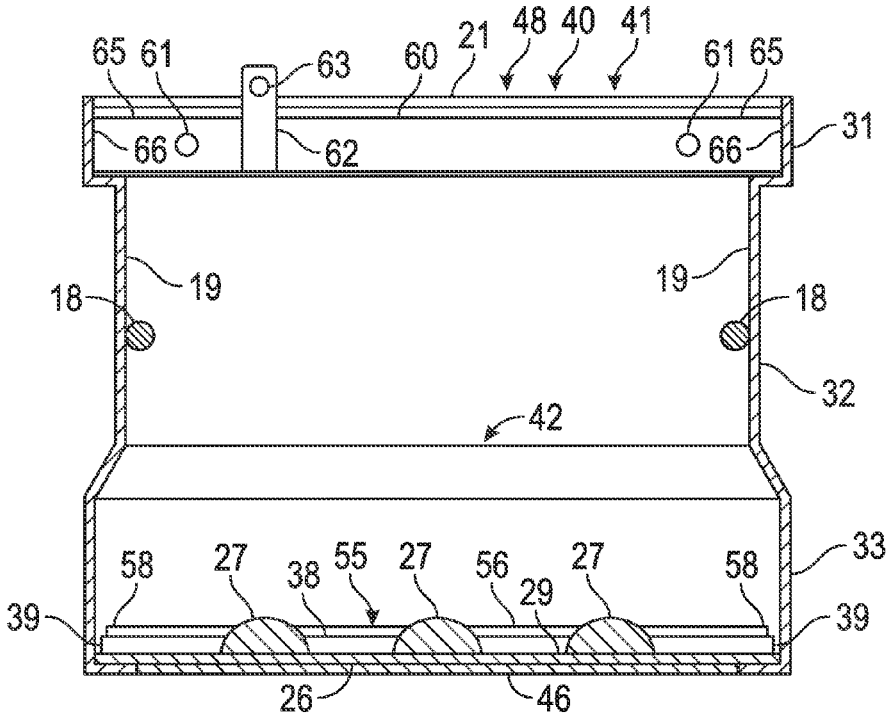
FIG. 12 is a partial schematic cross-sectional view of section 12-12 of the casket box of FIG. 11 with the moveable panel section in the closed position.

In another example shown in FIGS. 11 and 12, the movable panel section 48 extends the width of the casket box 20 such that the end panel 40 includes the movable panel section 48 and the end panel bottom portion 46, which are attached via a continuous hinge 55 extending the transverse width of the end panel 40. The movable panel section 48 is fixedly attached to the first hinge plate 56, for example, by welding the movable panel section 48 to the first hinge plate 56. The second hinge plate 57 of the continuous hinge 55 is fixedly attached to the bottom portion 46 of the end panel 40, for example, by welding the second hinge plate 57 to the bottom portion 46, and the bottom portion 46 is in turn welded to the floor panel 26 and the adjacent side panels 30 to operatively connect the movable panel section 48 to the casket box 20. A reinforcement member 38 extends the transverse width of the casket box 20 and the length of the continuous hinge 55, and is fixedly attach to the casket box 20 and to the second hinge plate 57 to reinforce the continuous hinge 55 and to reinforce and stabilize the casket box 20. As previously described, the bottom portion 46 of the end panel 40 may also include a integral rib or stiffening channel 47 to stiffen the casket box 20 structure, and the reinforcement member 38 may be attached to the stiffening channel 47.

In the example shown in FIGS. 11 and 12, the opening 78 extends the full transverse cross-section of the casket box 20 defined by the side panels 30 and floor panel 26 of the casket box 20, and such that the clearance gap 19 between the panel section 48 and the casket box 20 with the panel section 48 in the closed position is defined by the end panel 40 mitered and vertical edges and the side panel 30 mitered and vertical edges. In the example shown, the transverse member 60 is positioned as described for the example shown in FIGS. 1-5, such that each member end of the transverse member 60 is positioned in the upper rail recess 23 defined by a side panel 30 upper rail 22 and welded or otherwise fixedly attached to the side interior surface 36 to connect the opposing side panels 30. The transverse member 60 shown in FIGS. 11-12 is positioned flush with the end of the side panels 30, such that the transverse member 60 is fixedly attached so as to be perpendicular to the opposing side panels 30 and substantially parallel to the floor panel 26, to reinforce and stabilize the casket box 20 and to provide a substantially rectangular opening 78 through which the casket insert 69 may be insert into and removed from the casket box 20 as previously described.

The transverse member 60 in the example shown includes threaded interfaces 61 located respectively adjacent the transverse member ends 65. The threaded interfaces 61 are configured to receive locking members 50 inserted through the through holes 49 in the end panel upper rail portion 41 and positioned to align with the threaded interfaces 61 with the panel section 48 in the closed position. In the closed position, a clearance gap 19 is defined between the side panel 30 vertical and mitered edges and the end panel 40 vertical and mitered edges. The through holes 49 in the end panel 40 and the threaded interfaces 61 in the transverse member 60 are located such that the locking member 50 in the installed position extends into the upper rail recess 23, and is located immediately adjacent the clearance gap 19 defined by the adjacent edges of the end panel 40 and the side panel 30, to retain the movable panel section 48 in a closed position such that the clearance gap 19 is of uniform width between the adjacent vertical edges and the adjacent mitered edges of the movable panel section 48 and the side panels 30. In one example, the panel section 48 is closely aligned to the side panels 30 in the closed position such that the clearance gap 19 is substantially non-existent, e.g., the adjacent edges of the side panel 30 and the end panel 40 are in continuous contact.

In another example, and as previously described, edge protectors 59 may be applied to the edges of the movable panel section 48 to cushion contact between the movable panel section 48, to prevent scuffing of the adjacent edges, and/or to fill or minimize the clearance gap 19 between the panel section 48 and the adjacent side panel 30 to provide an aesthetically pleasing appearance. The edge protectors 59 may be configured to protect a portion of the edge, such as the vertical portion, or may be configured to extend the full length of the edge defining the clearance gap 19. In another example (not shown), an ornamental such as a corner molding may be operatively attached to the exterior of the casket box 20 with the panel section 48 in the closed position, to at least partially cover the clearance gap 19 and/or to minimize visibility of the clearance gap 19 when viewing the exterior surface of the casket.

The example shown in FIGS. 11 and 12 is non-limiting, and it would be understood that an arched transverse member 60 as shown in and described for FIGS. 8-10 could be used with the panel section 48 configuration shown in FIGS. 11-12, to provide additional vertical clearance between the transverse member 60 and the top surface 73 of the insert. The arched transverse member 60 would be offset longitudinally inboard from the end of the casket box 20 such that the arched portion 64 of the transverse member 60 extends into the casket lid cavity 14 with the casket lid 11 in a closed-casket position. Similar to the configuration shown in FIGS. 8-10, a travel stop 79 would be positioned in the upper rail recess 23 of each side panel 30 and attached to the side interior surface 36 of the upper rail recess 23 immediately adjacent to the end of the side panel 30, such that the panel section 48 in the closed position contacts the travel stops 79, and is prevented from moving inwardly into the interior area of the casket box 20. The panel section 48 is retained against the travel stops 79 in a generally vertical position, e.g., substantially perpendicular to the floor surface 29 and to the side panels 30, to align the panel section 48 with the adjacent side panels 30, and/or to minimize the clearance gap 19 between the panel section 48 and each adjacent side panel 30. Each of the travel stops 79 defines a through hole 49 positioned relative to the corresponding threaded interface 61 of the transverse member 60 such that each through hole 49 of the travel stop 79 is in alignment with a respective corresponding through hole 49 of the panel section 48 and the corresponding threaded interface 61 defined by the arched transverse member 60. The panel section 48 is retained to the casket box 20 in the closed position by locking members 50 which are of sufficient length to extend through the through hole 49 of the panel section 48 and the through hole 49 of the travel stop 79 to engage the threaded interface 61 of the transverse member 60.

A method for making the reusable casket 10 including the casket box 20 is provided herein. In a first example, a method of making the casket box 20 shown in FIGS. 1-10 is described, the casket box 20 having one end panel 40 defining a movable panel section 48 such that the casket box 20 can be opened at one end, and another end panel 40 which is a conventional, e.g., a non-opening end panel 40. For clarity of description in the present example, the non-opening end panel 40 will be referred to as a head end panel 40, and the end panel 40 having the movable, e.g., openable, panel section 48 will be referred to as the foot end panel 40. In the method, the side panels 30 are pre-formed by stamping and/or or bending sheet metal to define the side upper rail, side intermediate and side lower rail portions 31, 33, 32 and bottom portions (not shown) of the side panels 30. Similarly, the head and foot end panels 40 are pre-formed, for example, by stamping and/or bending sheet metal to define the end upper rail portion 41, end intermediate portion 43, end lower rail portion 42 and bottom portion 46 of each end panel 40 as shown in FIGS. 6A-6D.

The side panels 30 and the head end panel 40 are welded to the floor panel 26 such that the side panels 30 and head end panel 40 extend vertically upward from the horizontal floor panel 26. The non-opening head end panel 40 is welded to the adjacent side panels 30 to join the respective side panel 30 miter and vertical edges to the respective head end panel 40 miter and vertical edges, to form panel to panel weld seams 28

(similar to the panel to panel weld seams 28 shown in FIG. 3 attaching the side panel 30 to the foot end panel 40) to partially form the casket box 20. Guide rods 18 are fixedly attached to the side interior surface 36 of the respective side panels 30, for example, by welding. Optionally, the guide rods 18 may be welded to the side panels 30 prior to attaching the side panels 30 to the floor panel 26. Guide rails 27 are fixedly attached to the floor surface 29 of the floor panel 26, for example, by welding or otherwise adhering the guide rails 27 to the floor panel 26. Optionally, the guide rails 27 may be attached to the floor panel 26 prior to attaching the side panels 30 to the floor panel 26, or as described previously herein, the guide rails 27 may be integral to the floor panel 26, for example, stamped into the floor panel 26.

Figure 7B:
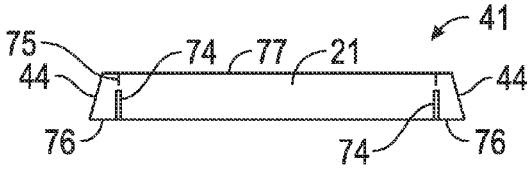
FIGS. 7A-7B are respectively front and top views of the end panel of FIGS. 6A-6D after perforation of the end panel.
Figure 7A:
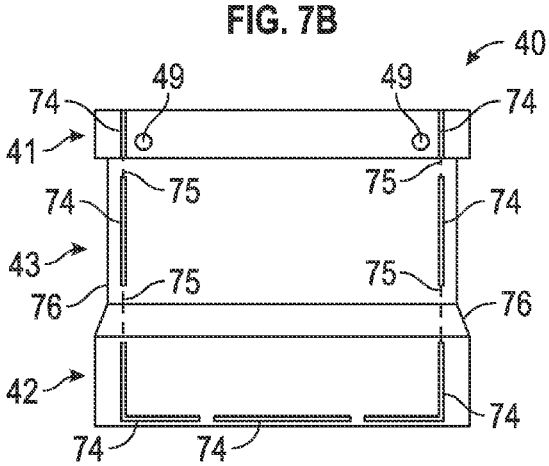

Prior to welding the foot end panel 40 shown in FIGS. 6A-6D to the casket box 20, and referring to FIGS. 7A-7B, perforations 74 are formed in the foot end panel 40 along cut lines shown as broken lines in FIGS. 7A-7B to define a central section 77 of the end panel 40 which will be separated from the end panel 40 and welded to the continuous hinge 55 to form the movable panel section 48 shown in FIGS. 1-5. The perforations 74 may be configured as a series of intermittent slits 74 (shown) or small holes (not shown) formed along the cut lines. The perforations 74 are separated along the cut line by uncut material 75. The uncut material 75 may be removed after welding the foot end panel 40 to the casket box 20, to separate the panel section 48 from the end panel 40, as further described herein. Optionally, the uncut material 75 along the cut line may be scribed or otherwise marked to visually identify the cut line during separation of the panel section 48 from the end panel 40 in a subsequent operation. The perforations 74 may be formed by any suitable metal cutting means including by way of non-limiting example, drilling, cutting, punching, blanking, or other forms of metal cutting, for example, laser or plasma cutting. In the example shown, the perforations 74 are formed by laser cutting.

Perforating and/or scribing the cut lines 75 defining the panel section 48 provides the advantage of retaining the panel section 48 in a fixed spatial relationship to the remainder of the end panel 40 during welding of the end panel 40 to the casket box 20 and optionally, during welding of the panel section 48 to the continuous hinge 55, as will be described in further detail herein, such that the remaining material can be cut between the perforations 74 after the end panel 40 is fixed in place to provide a uniform gap clearance defined by the cut line and to facilitate alignment of the panel section 48 and the lateral sections 76 of the end panel 40 by cutting the panel section 48 from the end panel 40 to which it will reconnected via the continuous hinge 55, such that the panel section 48 and end panel 40 remain a matched set through fabrication and assembly of the casket box 20. Perforating and/or scribing the cut lines (shown as broken lines in FIGS. 7A-7B) defining the panel section 48 provides the advantage of reducing the amount of material which must be later cut to separate the panel section 48 from the end panel 40.

The through holes 49 defined by the end panel upper rail portion 41 are formed in the foot end panel 40 by any suitable metal forming means, which may include, by way of non-limiting example, drilling, cutting, laser cutting, punching, blanking, or otherwise forming the through holes 49. The through holes 49 may be formed in the foot end panel 40 prior to or concurrently with forming the foot end panel 40 shown in FIGS. 6A-6D. For example, the through holes 49 may be punched in the foot end panel 40 during a stamping operation forming the foot end panel 40 shown in FIGS. 6A-6D. The through holes 49 may be formed in the foot end panel 40 concurrently with perforating the foot end panel 40 shown in FIGS. 7A-7B, or after perforating the foot end panel 40, for example, such that the perforations 74 may be used as a reference or datum to positioning the holes 49, 61 in the panel section 48. The through holes 49 may be formed after the foot end panel 40 and the transverse member 60 have been welded to the casket box 20, for example by drilling, such that the through holes 49 may be positioned using the threaded interfaces 61 of the transverse member 60 as a reference for placement of the through holes 49.

In a first example sequence of operations, the perforated end panel 40 is welded to the casket box 20 by welding the bottom portion 46 of the perforated end panel 40 to the bottom portions (not shown) of the floor panel 26 and to the side panels 30 and by welding the end panel 40 vertical and mitered edges to the corresponding side panel 30 vertical and mitered edges to form the weld seams 28 shown in FIG. 3. The casket box 20 may be fixtured during welding (not shown), for example, to orient and/or square up the floor, side, and/or end panels 26, 30, 40 and/or to hold the floor, side, and/or end panels 26, 30, 40 in a fixed orientation during the welding process to obtain dimensional and positional accuracy of the floor, side, and/or end panels 26, 30, 40 relative to each other during fabrication of the casket box 20. After welding the perforated panel to the casket box 20, the transverse member 60 is positioned with a member end in the upper rail recess 23 of each of the opposing side panels 30. The transverse member 60 is positioned for welding such that it is substantially perpendicular to the side panels 30 and parallel to the perforated end panel 40, to align the end panel 40 through holes 49 with the threaded interfaces 61 defined by the transverse member 60.

In the example shown in FIGS. 3-5, the transverse member 60 is positioned for welding in the side panel 30 upper rail 22 immediately adjacent the ends of the side panel 30 and proximate to the perforated end panel 40, and is fixedly attached in position to the side panels 30, for example, by welding each member end to a respective side interior surface 36 of the side panel 30 upper rail recess 23. The transverse member 60 may be positioned in the end panel 40 upper rail recess 23 and in contact with the lateral sections 76 of the perforated end panel 40 and each of the member ends 65 may be fixedly attached to a respective lateral section 76 of the perforated end panel 40, for example, by welding the member end to the interior surface of the upper rail recess 23 defined by the lateral section 76 at the weld attachment points 66. The transverse member 60 so positioned with the member end welded to both the side panel 30 and the lateral section 76 of the end panel 40 stabilizes and contributes strength to the casket box 20 in the transverse direction, such that the casket box 20 resists twisting and/or distortion and maintains dimensional stability over repeated use as a rent casket, e.g., over time and repeated movement of loaded casket inserts 69 into and out of the casket box 20.

In the example shown in FIGS. 8-10, the transverse member 60 includes an arched portion 64. The arched transverse member 60 is positioned in the side panel 30 upper rail 22 such that the arched transverse member 60 is offset longitudinally inward from the ends of the side panel 30 and from the perforated end panel 40, and is fixedly attached in position to the side panels 30, for example, by welding each member end to a respective side interior surface 36 of the side panel 30 upper rail recess 23. The transverse member 60 so positioned with the member end welded to both side panels 30 stabilizes and contributes strength to the casket box 20 in the transverse direction, such that the casket box 20 resists twisting and/or distortion and maintains dimensional stability over repeated use as a rent casket 10, e.g., over time and the repeated movement of loading casket inserts 69 into and out of the casket box 20. Travel stops 79 are positioned as shown in FIGS. 8 and 9 and fixedly attached, for example, by welding each travel stop 79 to the interior surface of the upper rail recess 23 of the respective lateral section 76 of the end panel 40, such that the travel stops 79 extend into the opening 78 as shown, and with the through hole 49 of each travel stop 79 aligned to the threaded interface 61 of the transverse member 60 and the through hole 49 of the panel section 48 in the closed position. The travel stop 79 may be positioned during welding, in one example, by inserting a locking element 50 or a positioning fixture (not shown) through the through hole 49 of the perforated end panel 40, the through hole 49 of the travel stop 79, and into the threaded interface 61 such that the travel stop 79 is retained at or positioned in the aligned position during welding of the travel stop 79 to the lateral section 76.

After the transverse member 60 is welded to the casket box 20, in a next step the uncut material 75 between the horizontal perforations 74, e.g., between the perforations 74 defining the horizontal bottom 72 edge of the panel section 48 as shown in FIG. 7A, may be removed prior to assembling the continuous hinge 55 to the casket box 20. The uncut material 75 may be removed by cutting along the cut line using a metal cutting tool such as a reciprocating or rotary cutter, grinding wheel, plasma cutter, or other suitable metal cutting method to join the horizontal perforations 74 to form a single horizontal perforation 74 extending the width of the panel section 48. The cut edge may be finished by deburring, grinding, etc., to provide a continuous horizontal cut line. The continuous horizontal perforation 74 along the bottom 72 edge of the panel section 48 separates the bottom 72 edge of the panel section 48 from the bottom portion 46 of the foot end panel 40, while leaving panel section 48 attached to the lateral sections 76 by the remaining vertical portions of the uncut material 75.

In a next step, the continuous hinge 55 may be positioned in the interior of the casket box 20 such that the continuous hinge 55 is aligned with the horizontal perforation 74 extending the width of the panel section 48, and with the first hinge plate 56 in contact with the bottom portion 46 of the end panel 40 and the second hinge plate 57 in contact with the bottom 72 edge of the panel section 48, as shown in FIGS. 4 and 9. The continuous hinge 55 is then fixedly attached in position, for example, by welding the first hinge plate 56 in position to the bottom portion 46 of the end panel 40 and welding the second hinge plate 57 in position to the bottom 72 edge of the panel section 48. The panel section 48 is held in position during welding of the continuous hinge 55 by the uncut material 75 extending between the vertical perforations 74 and retaining the panel section 48 to the lateral sections 76 of the end panel 40.

The reinforcement member 38 is positioned as shown in FIGS. 3-5 and 8-10, such that the reinforcement member 38 extends the width of the floor panel 26 and is substantially parallel to the transverse member 60 and perpendicular to the side panels 30. The reinforcement member 38 is positioned adjacent to or overlapping the first hinge plate 56 and in contact with the bottom portion 46 of the end panel 40, as shown in FIGS. 3-5 and 8-10, and is welded in position by welding the transverse edges of the reinforcement member 38 to the adjacent first hinge plate 56 and to the bottom portion 46 of the end panel 40, and welding the member end portions 59 to the side panels 30 at the weld attachment points 66.

The remaining uncut material 75 separating the vertical perforations 74 is removed, for example, using a cutting or grinding wheel, rotary or reciprocating, plasma cutter, etc., to form the vertical clearance gaps 19 between the panel section 48 and the lateral sections 76 to separate the panel section 48 from the lateral sections 76 of the end panel 40 such that the separated panel section 48 is rotatably movable via the continuous hinge 55 between the closed and open position. Completing the welding of the casket box 20, including welding of the end panel 40 to the side and floor panels 30, 26 and welding of the transverse member 60, continuous hinge 55, and (optionally) the reinforcement member 38, prior to removing the uncut material 75 to fully separate the panel section 48 from the bottom 72 and lateral sections 76 of the end panel 40 aligns the movable panel section 48 to the transverse member 60, the continuous hinge 55, and the lateral sections 76 of the end panel 40 such that when the clearance gaps 19 are formed by removing the remaining vertical portions of uncut material 75, no further alignment or adjustment of the position of the panel section 48 is required, and the alignment and position of the panel section 48 is unaffected by weld distortion. Additional advantages of this method include, for example, clearance gaps 19 of uniform width and appearance between the panel section 48 which are unaffected by welding distortion, accurate and precise alignment of the panel section 48 to the opening 78 and between the through holes 49 and the threaded interfaces 61 of the transverse member 60, such that the panel section 48 is not distorted when attached to the transverse member 60 in the closed position, fabrication of the movable panel section 48 and the end panel 40 as a matched set, etc.

It would be understood that the sequence of steps may be varied from the sequence(s) described herein, within the scope of the disclosure. For example, the reinforcement member 38 may be welded to the casket box 20 before or after removing the uncut material 75 between the perforations 74 fully separating the panel section 48 from the end panel 40. In another example, the panel section 48 may be retained to the transverse member 60 by locking members 50 during one or more of welding of the continuous hinge 55, welding of the reinforcement member 38, removing the uncut material 75, etc. to align the panel section 48 to the transverse member 60 and to the casket box 20 during these operations.

The method continues with additional steps to finish the casket box 20, which may include, for example, finishing the edges of the panel section 48 and lateral sections 76 of the end panel 40 defining the clearance gap 19, grinding and/or polishing the exterior surface of the weld seams 28 joining the end, side, and floor panels 40, 30, 26 in preparation for additional surface finishing such as painting or other surface finishing, surface finishing the exterior surface of the casket box 20, which may include buffing, polishing, texturizing such as brush finishing, painting, coating, glazing, etc., the exterior surface to provide an appearance surface; attaching trim, handles, locks, lid supports 12, etc.

In a second example method used to fabricate the casket box 20 shown in FIGS. 11-12, the casket box 20 is partially formed as described previously, including the side panels 30, floor panel 26, head end panel 40, guide rods 18 and guide rails 27. In the example shown in FIGS. 11-12, the foot end panel 40 may be perforated to provide horizontal perforations 74 corresponding to a cut line separating the bottom portion 46 of the end panel 40 from the remaining portion of the end panel 40, where the remaining portion of the end panel 40 defines the panel section 48 and is attachable to a continuous hinge 55 which extends the transverse width of the casket box 20, as shown in FIG. 11. In one example, the foot end panel 40 may be attached to the casket box 20 prior to separating the panel section 48 from the end panel 40 by welding the bottom portion 46 of the end panel 40 to the side panels 30 and the floor panel 26. The casket box 20 may be squared up to align the vertical and mitered edges of the end panel 40 to the vertical and mitered edges of the side panels 30, that is, to align the panel section 48 portion of the end panel 40 to the side panels 30 such that the clearance gaps 19 between the panel section 48 and the side panels 30 are uniform. The transverse member 60 may be inserted and welded in position to retain the side panels 30 in the squared up position. The panel section 48 may be attached to the transverse member 60 by locking bolts 50 before or after welding the transverse member 60 in position and prior to removing the uncut material 75 between the horizontal perforations 74, to retain the panel section 48 in position and aligned to the side panels 30 during attachment of the continuous hinge 55 to the casket box 20. The uncut material 75 is removed between the horizontal perforations 74 to separate the panel section 48 from the bottom portion 46 of the end panel 40, and the continuous hinge 55 is positioned in the interior of the casket box 20 and welded to the panel section 48 and the bottom portion 46 of the end panel 40 as previously described for FIGS. 3-5. The reinforcement member 38 may then be positioned and welded to the second hinge plate 57 the casket box 20 as shown in FIG. 11 to reinforce the casket box 20 and the continuous hinge 55 in the transverse direction. Alternatively, the transverse member 60 may be attached to the panel section 48 using locking members 50 and the transverse member 60 and panel section 48 aligned to the side panels 30 and opening 78 prior to welding the transverse member 60 in position.

Other methods of forming the casket box 20 of FIGS. 11-12 may be used. For example, the panel section 48 may be non-integral to the end panel 40, such that the end panel 40 consists of the bottom portion 46 only. The floor panel 26 may be configured such that the bottom portion 46 of the end panel 40 is integral to the floor panel 26, eliminating the need to attach this portion as a separate element, and such that the panel section 48 shown in FIG. 11 is directly attached to the floor panel 26 via the continuous hinge 55. Alignment of the non-integral panel section 48 to the opening 78 may be optimized by, in a first example, attaching the panel section 48 to the transverse member 60 and positioning the panel section 48 with the transverse member 60 attached in the opening 78, squaring up the side and floor panels 30, 26 to the panel section 48 to align the clearance gaps 19, and welding the transverse member 60 in position, to retain the panel section 48 in an aligned position to the casket box 20 while subsequently welding the first and second plates 56, 57 of the continuous hinge 55 to the panel section 48 and floor panel 26, respectively, to complete attachment of the panel section 48 to the casket box 20. Optionally, the first hinge plate 56 may be welded to the panel section 48 prior to positioning the transverse member 60 with the panel section 48 attached, such that the continuous hinge 55 is aligned to the casket box 20 concurrently with alignment of the panel section 48 to the opening 78, and is attached by welding the second plate of the continuous hinge 55 to the floor panel 26 before or after welding the transverse member 60 in the aligned position.

In another example (not shown), the casket box 20 of FIGS. 11-12 may be fabricated including a transverse member 60 including an arched portion 64. The transverse member 60 including the arched portion 64 is welded to the upper rail portions 31 of the side panels 30 as discussed related to FIGS. 8-10, such that the transverse member 60 is offset longitudinally toward the center of the casket box 20, so that with the casket in a closed-casket condition the arched portion 64 of the transverse member 60 extends into the lid cavity 14 and does not interfere with the lid frame 13. Travel stops 79 may be positioned in the upper rail recess 23 of the side upper rail portion 31 immediately adjacent the end of the side panel 30, to prevent inward travel of the panel section 48. The travel stop 79 may include a through hole 49 to receive the locking member 50, as shown in FIG. 8.

The method of forming the casket box 20 of FIGS. 11-12 continues with additional steps to finish the casket box 20, which may include, for example, finishing the edges of the panel section 48 and lateral sections 76 of the end panel 40 defining the clearance gap 19, grinding and/or polishing the exterior surface of the weld seams 28 joining the end, side, and floor panels 40, 30, 26 in preparation for additional surface finishing such as painting or other surface finishing, surface finishing the exterior surface of the casket box 20, which may include buffing, polishing, texturizing such as brush finishing, painting, coating, glazing, etc., the exterior surface to provide an appearance surface; attaching trim, handles, locks, lid supports 12, etc.

The examples described herein are intended to be non-limiting, and other configurations and method of fabricating the metal casket box 20 including the movable panel section 48 and transverse member 60 may be used. For example, the panel section 48 may be formed separately from the end panel 40. In this example, the foot end panel 40 could be formed to define the opening 78 prior to being welded to the side and floor panels 30, 26 of the casket box 20, or could be formed as shown in FIGS. 7A-7B, and the central section 77 of the foot end panel 40 removed as waste material after welding the foot end panel 40 and the transverse member 60 to the casket box 20, such that the central section 77 is removed after the casket box 20 has been squared up and reinforced by the transverse member 60 to stabilize the end panel 40 prior to removing the central portion. A non-integral panel section 48 can then be aligned to the opening 78 and fixedly attached to the casket box 20. In this example, the continuous hinge 55 may be attached to the non-integral panel section 48 by welding, riveting, etc. the first plate of the continuous hinge 55 to the panel section 48 prior to aligning the panel section 48 with the continuous hinge 55 attached to the opening 78 and welding the second plate of the continuous hinge 55 to the bottom portion 46 of the end panel 40 to rotatably attach the panel section 48 to the casket box 20. The non-integral panel section 48 may be aligned to the opening 78 and/or to the transverse member 60, for example, by fastening the non-integral panel to the transverse member 60 using locking members 50 to position the non-integral panel section 48 prior to attaching the continuous hinge 55 to the panel section 48 and/or the casket box 20. The transverse member 60 may be welded to the side panels 30 to stabilize and square up the casket box 20 prior to welding the foot end panel 40 to the casket box 20, such that the welded transverse member 60 acts as a fixture to position the side panels 30 relative to each other and to the floor panel 26 to receive the foot end panel 40. An end panel 40 defining the opening 78 may be welded to the side and bottom 72 panels 26, 30, 40, and a non-integral panel section 48 may be fastened to the transverse member 60 using locking members 50, prior to aligning the non-integral panel section 48 attached to the transverse member 60 to the opening 78, then welding the transverse member 60 in position to the side panels 30. These additional examples are non-limiting, and other configurations and combinations of method steps may be used to make the reusable casket 10 as described herein and shown in the figures.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A casket box for a casket insert, the casket box comprising:

a floor panel;

opposing side panels;

opposing end panels;

an opening defined by one of the end panels;

the one end panel comprising a panel section rotatably attached to the casket box and movable between a closed position enclosing the opening and an open position allowing longitudinal movement of the casket insert into and out of the casket box through the opening;

a transverse member adjacent the panel section and connecting the opposing side panels such that the opening is partially defined by the transverse member;

the transverse member including an interface to engage a locking member;

the panel section receiving the locking member such that the locking member engages with the interface to retain the panel section to the transverse member in the closed position; and wherein the casket box is made of a metal material.

2. The casket box of claim 1, further comprising:

an upper rail defined by the casket box; and wherein the locking member extends through the upper rail to engage the interface.

3. The casket box of claim 1, wherein:

the locking member is configured to receive a casket key.

4. The casket box of claim 1, further comprising:

an upper railing defining an upper surface;

wherein the transverse member is flush with the upper surface.

5. The casket box of claim 1, wherein the transverse member has an arched portion.

6. The casket box of claim 1, further comprising:

the transverse member comprising an attachment interface to receive a casket lid support.

7. A method of making a casket box for a casket insert, the method comprising:

attaching opposing side panels and opposing end panels to a floor panel to form the casket box;

wherein one of the end panels defines an opening and comprises a panel section;

rotatably attaching the panel section to the casket box such that the panel section is movable between a closed position enclosing the opening in the casket box and an open position allowing longitudinal movement of the casket insert into and out of the casket box through the opening;

attaching a transverse member to the opposing side panels adjacent the panel section such that the opening is partially defined by the transverse member;

wherein:

the transverse member includes an interface to engage a locking member;

the panel section is receiving the locking member such that the locking member engages the interface to retain the panel section to the transverse member in the closed position; and the side panels, end panels, floor panel, and panel section are made of metal and attached by welding.

8. The method of claim 7, further comprising:

wherein the one end panel is a perforated panel including a plurality of perforations defining the panel section.

9. The method of claim 8, wherein:

the panel section is attached to the one end panel by uncut material extending between the perforations;

the method further comprising:

removing the uncut material to separate the panel section from the one end panel;

wherein the panel section is separated from the one end panel after the one end panel is welded to one of the floor panel and the opposing side panels.

10. The method of claim 7, further comprising:

forming plurality of perforations in the one end panel.

11. The method of claim 10, further comprising:

laser cutting the plurality of perforations in the one end panel.

12. The method of claim 7, wherein rotatably attaching the panel section to the casket box further comprises:

attaching a first hinge plate of a continuous hinge to the panel section; and attaching a second hinge plate of a continuous hinge to the casket box such that the panel section is rotatably attached to the casket box to enclose the opening in the closed position.

13. The method of claim 12, further comprising:

attaching a reinforcement member to the second hinge plate and to the casket box inner surface adjacent the second hinge plate;

wherein:

the reinforcement member extends the width of the casket box.

14. A casket box for a casket insert, the casket box comprising:

a floor panel;

opposing side panels;

opposing end panels;

an opening defined by one of the end panels;

the one end panel comprising a panel section rotatably attached to the casket box and movable between a closed position enclosing the opening and an open position allowing longitudinal movement of the casket insert into and out of the casket box through the opening;

a transverse member adjacent the panel section and connecting the opposing side panels such that the opening is partially defined by the transverse member;

an upper railing defining an upper rail recess;

wherein the transverse member is positioned within the upper rail recess; and wherein the casket box is made of a metal material.

15. A casket box for a casket insert, the casket box comprising:

a floor panel;

opposing side panels;

opposing end panels;

an opening defined by one of the end panels;

the one end panel comprising a panel section rotatably attached to the casket box and movable between a closed position enclosing the opening and an open position allowing longitudinal movement of the casket insert into and out of the casket box through the opening;

a transverse member adjacent the panel section and connecting the opposing side panels such that the opening is partially defined by the transverse member;

the transverse member longitudinally offset from the one end panel;

a travel stop extending into the opening such that the travel stop is in contact with the panel section in the closed position; and wherein the casket box is made of a metal material.

16. The casket box of claim 15, further comprising:

the transverse member having a first end and a second end and an arched portion disposed between the first and second ends.

17. A casket box for a casket insert, the casket box comprising:

a floor panel;

opposing side panels;

opposing end panels;

an opening defined by one of the end panels;

the one end panel comprising a panel section rotatably attached to the casket box and movable between a closed position enclosing the opening and an open position allowing longitudinal movement of the casket insert into and out of the casket box through the opening;

a transverse member adjacent the panel section and connecting the opposing side panels such that the opening is partially defined by the transverse member;

a rotatable member rotatably attaching the panel section to the casket box;

a reinforcement member extending the width of the casket box;

wherein the reinforcement member is fixedly connected to the rotatable member and the casket box; and wherein the casket box is made of a metal material.

18. A casket box for a casket insert, the casket box comprising:

a floor panel;

opposing side panels;

opposing end panels;

an opening defined by one of the end panels;

the one end panel comprising a panel section rotatably attached to the casket box and movable between a closed position enclosing the opening and an open position allowing longitudinal movement of the casket insert into and out of the casket box through the opening;

a transverse member adjacent the panel section and connecting the opposing side panels such that the opening is partially defined by the transverse member;

each side panel comprising a longitudinal guide rod extending from an inside surface of the side panel; and wherein the guide rod is in contact with the casket insert during longitudinal movement of the casket insert into and out of the casket box; and wherein the casket box is made of a metal material.

19. A casket box for a casket insert, the casket box comprising:

a floor panel;

opposing side panels;

opposing end panels;

an opening defined by one of the end panels;

the one end panel comprising a panel section rotatably attached to the casket box and movable between a closed position enclosing the opening and an open position allowing longitudinal movement of the casket insert into and out of the casket box through the opening;

a transverse member adjacent the panel section and connecting the opposing side panels such that the opening is partially defined by the transverse member;

the one end panel defining the opening comprising the panel section and first and second lateral sections;

each lateral section is fixedly attached to a respective one of the opposing side panels;

the panel section is intermediate the lateral sections;

wherein the panel section is movable relative to the lateral sections; and wherein the casket box is made of a metal material.

* * * * *

UNITED STATES PATENT AND TRADEMARK OFFICE

CERTIFICATE OF CORRECTION

PATENT NO. : 8,914,953 B1
APPLICATION NO. : 14/065836
DATED : December 23, 2014
INVENTOR(S) : Carl Justin Thacker It is certified that error appears in the above-identified patent and that said Letters Patent is hereby corrected as shown below:

In the Claims

Column 24, line 11, should be changed to "forming a plurality of perforations in the one end panel.".

Signed and Sealed this
Twenty-first Day of April, 2015

Michelle K. Lee

Michelle K. Lee
*Director of the United States Patent and Trademark Office*